US006833036B2

(12) United States Patent
Nakane et al.

(10) Patent No.: US 6,833,036 B2
(45) Date of Patent: Dec. 21, 2004

(54) RARE EARTH PERMANENT MAGNET

(75) Inventors: Makoto Nakane, Tokyo (JP); Eiji Kato, Tokyo (JP); Chikara Ishizaka, Tokyo (JP); Akira Fukuno, Tokyo (JP)

(73) Assignee: TDK Corporation, Tokyo (JP)

( * ) Notice: Subject to any disclaimer, the term of this patent is extended or adjusted under 35 U.S.C. 154(b) by 83 days.

(21) Appl. No.: 10/185,767

(22) Filed: Jun. 27, 2002

(65) Prior Publication Data

US 2003/0141951 A1 Jul. 31, 2003

(30) Foreign Application Priority Data

Jun. 29, 2001 (JP) ..... 2001-200150
Oct. 26, 2001 (JP) ..... 2001-329866

(51) Int. Cl.[7] ..... H01F 1/057

(52) U.S. Cl. ..... 148/302; 420/83; 420/121

(58) Field of Search ..... 148/302; 420/83, 420/121

(56) References Cited

U.S. PATENT DOCUMENTS

| | | | | | |
|---|---|---|---|---|---|
| 4,765,848 | A | * | 8/1988 | Mohri et al. | 148/302 |
| 5,545,266 | A | * | 8/1996 | Hirosawa et al. | 148/302 |
| 6,511,552 | B1 | * | 1/2003 | Makita et al. | 148/302 |

FOREIGN PATENT DOCUMENTS

| | | | |
|---|---|---|---|
| DE | 4 135 403 | | 4/1993 |
| DE | 19 945 943 | | 4/2001 |
| EP | 0 106 948 | * | 5/1984 |
| JP | 59-089401 | | 5/1984 |
| JP | 59-132104 | | 7/1984 |
| JP | 60-032306 | | 2/1985 |
| JP | 62-116756 | | 5/1987 |
| JP | 62-244105 | | 10/1987 |
| JP | 06-283318 | | 10/1994 |
| JP | 07-050205 | | 2/1995 |

* cited by examiner

*Primary Examiner*—John P. Sheehan
(74) *Attorney, Agent, or Firm*—Hogan & Hartson, LLP

(57) ABSTRACT

A rare earth permanent magnet consists of 20–40 wt % of at least one rare earth element R, 0.5–4.5 wt % of boron B, 0.03–0.5 wt % of M (at least one of Al, Cu, Sn and Ga), 0.01–0.2 wt % of Bi, and the balance being at least one transition metal element T.

19 Claims, 9 Drawing Sheets

RARE EARTH PERMANENT MAGNET

BACKGROUND OF THE INVENTION

1) Field of the Invention

The present invention relates to a rare earth permanent magnet having rare earth elements R, transition metal elements T and boron B as a main composition, which provides excellent magnetic properties.

2) Description of Related Art

Among rare earth permanent magnets, demand for Nd—Fe—B system magnets has increased annually because of its excellent magnetic properties and because it is relatively inexpensive due to the abundant resources of Nd. Research and development to enhance the magnetic properties of Nd—Fe—B system magnet is being made vigorously. In recent years, a mixing method, wherein various kinds of metal powder and alloy powder of different compositions are mixed and then sintered, has become the main stream in the manufacturing of high performance Nd—Fe—B system magnets.

However, since Curie temperature of the Nd—Fe—B system magnets is low, its coercive force declines as temperature rises. Various attempts have been made to solve this problem. For example, it has been proposed that adding heavy rare earth elements such as Dy and Tb to the Nd—Fe—B system magnets is effective to enhance the coercive force (hereinafter, refer to as "conventional art A").

Also, it has been proposed that appropriately changing the mixing ratio of R-T system alloy powder against R-T-B system alloy powder is effective in enhancing the magnetic properties in a method for manufacturing R-T-B system rare earth permanent magnet that employs a mixing method using a main phase with $R_2T_{14}B$-system intermetallic compound (R is one or more selected from the group of rare earth elements and Y, and T is at least one transition metal element) being a main composition and the R-rich phase being a main composing phase (hereinafter, refer to as "conventional art B").

Also, it is proposed to add one or more of Ti, Ni, Bi, V, Nb, Ta, Cr, Mo, W, Mn, Al, Sb, Ge, Sn, Zr, Hf, Cu, Si and P (herein after referred to "Ti, etc.") in order to enhance the magnetic properties of rare earth permanent magnet (hereinafter, refer to as "conventional art C").

However, in the conventional art A, the addition of heavy rare earth elements such as Dy and Tb would enhance the coercive force but lower its residual magnetic flux density. Also, heavy rare earth elements are costly compared with other elements. Therefore, the key to the manufacturing cost reduction of rare earth permanent magnets is to decrease the volume of heavy rare earth element additives.

Moreover, rare earth permanent magnets manufactured in the conventional art B had a problem in that while they show a high residual magnetic flux density, the coercive force was low.

Moreover, it has been proposed in the conventional art C that Ti, etc. should be used as additives. However, no element has been specified for realizing both excellent coercive force and residual magnetic flux density.

SUMMARY OF THE INVENTION

In view of the above, the present invention provides a rare earth permanent magnet that excels in both coercive force and residual magnetic flux density.

Various studies were made by the present inventors to obtain high magnetic properties. As a result, it was discovered that Bi was effective in enhancing the magnetic properties of rare earth permanent magnets. In particular, when the Bi content is 0.01 to 0.2 wt % in the sintered magnet, it is possible to obtain a rare earth permanent magnet with excellent coercive force and residual magnetic flux density. Therefore, the present invention provides to a rare earth permanent magnet that essentially consists of 20–40 wt % of rare earth element R, 0.5–4.5 wt % of boron B, 0.03–0.5 wt % of M (at least one of Al, Cu, Sn and Ga), 0.01–0.2 wt % of Bi and the balance being at least one transition metal element T.

The rare earth permanent magnet according to the present invention may preferably contain 31–32.5 wt % of Nd+Dy, 0.5–1.5 wt % of boron B, 0.15 wt % or less (but not 0 wt %) of Cu, 0.15–0.3 wt % of Al, 2 wt % or less of Co (but not 0 wt %), 0.01–0.2 wt % of Bi, and Fe as the balance. Also, the Bi content may preferably be 0.02–0.1 wt %. Moreover, the Dy content may preferably be between 2 wt % and 15 wt %.

The rare earth permanent magnet according to the present invention produces excellent magnetic properties of 1.25 T or greater in residual magnetic flux density and coercive force of 1,650 kA/m or greater. In the present invention, it is desirable that Bi is dispersed in the grain boundary phase.

In the present invention described above, the content for M (at least one of Al, Cu, Sn and Ga) may be 0.03–0.5 wt %, and the Bi content be 0.01–0.2 wt %. However, only Bi, whose content be 0.01–0.2 wt %, is also effective without containing M.

Therefore, the present invention also provides to a rare earth permanent magnet may include 20–40 wt % of R, 0.5–4.5 wt % of boron B, 0.01–0.2 wt % of Bi and the balance being at least one transition metal element T.

The rare earth permanent magnet in accordance with the present invention presents excellent magnetic properties of 2,100 or greater (T×kA/m) in terms of the product (Br×Hcj) of residual magnetic flux density Br and coercive force Hcj. Also, the value obtained by dividing the coercive force Hcj by the weight percentage of the heavy rare earth element (Hcj/weight percentage of heavy rare earth element) is 230 or greater (kA/m×1/wt %). Therefore, according to the present invention, a rare earth permanent magnet with excellent magnetic properties can be obtained while reducing the amount of costly heavy rare earth element to be added. Here, as for heavy rare earth element, at least one element is selected from the group of Gd, Tb, Dy, Ho, Er, Yb and Lu.

Moreover, the salient point of the present invention is the effect of enhancing coercive force Hcj by adding a small amount of Bi. The value obtained by dividing the coercive force Hcj by the weight percentage of Bi (Hcj/weight percentage of Bi) is 8,000 or greater (kA/m×1/wt %).

Also, the present invention provides a rare earth permanent magnet comprising of a $R_2T_{14}B$ magnetic phase and a non-magnetic grain boundary phase wherein Bi is dispersed, with a value obtained by dividing the coercive force Hcj by the weight percentage of Bi (Hcj/weight percentage of Bi) being 8,000 or greater (kA/m×1/wt %).

Rare earth permanent magnets of the present invention described above are suitably applicable to sintered magnets.

Other objects, features and advantages of the invention will become apparent from the following detailed description taken in conjunction with the accompanying drawings.

BRIEF DESCRIPTION OF THE DRAWINGS

FIG. 1(*b*) is a graph showing the relationship between the Bi content and the residual magnetic flux density Br at room temperature of Samples No. 1 and No. 2 and Comparative Examples 1 and 4.

FIG. 2(*b*) is a graph showing the relationship between the Bi content and the residual magnetic flux density Br at room temperature of Samples No. 4–No. 7 and Comparative Examples 3 and 5.

FIG. 7(*b*) is a graph showing the residual magnetic flux density Br at room temperature of Samples No. 22 and No. 23, and Comparative Examples 20 and 21.

EMBODIMENTS OF THE PRESENT INVENTION

Figure 1A:
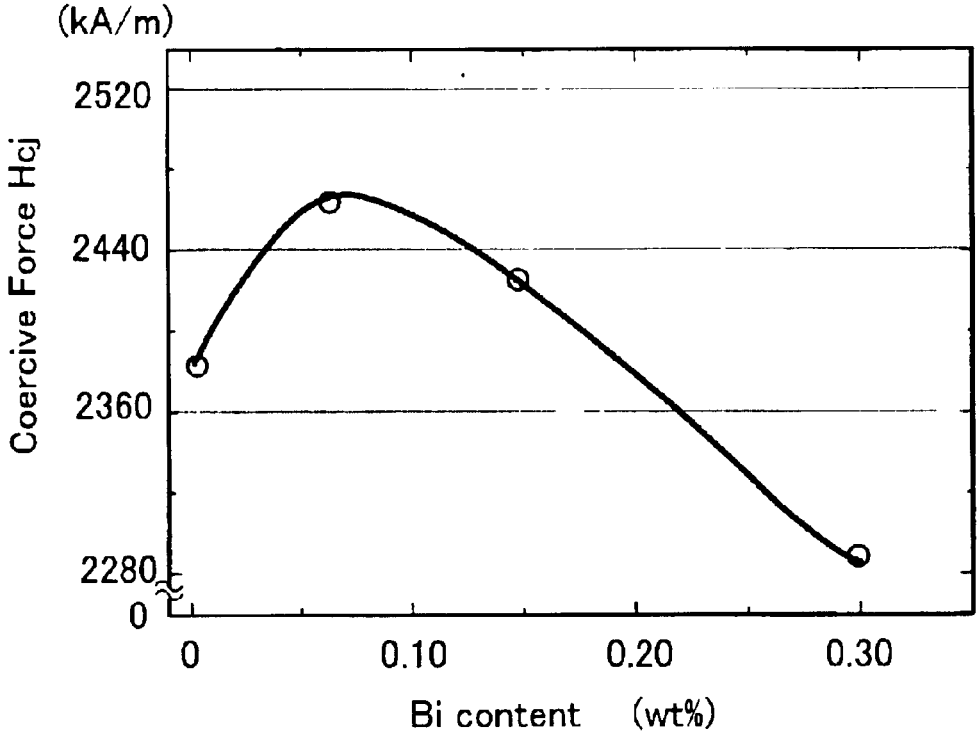
FIG. 1(*a*) is a graph showing the relationship between the Bi content and the coercive force Hcj at room temperature of Samples No. 1, No. 2 and Comparative Examples 1 and 4.

Embodiments of the present invention will be described below.

First, the composition of rare earth permanent magnet in accordance with a preferred embodiment of the present invention and the outline of the manufacturing method therefor will be explained.

A rare earth permanent magnet contains 20–40 wt % of rare earth element R. Here, at least one rare earth element R is selected from the group consisting of La, Ce, Pr, Nd, Sm, Eu, Gd, Tb, Dy, Ho, Er, Yb and Lu, and Y (Note: as for heavy rare earth element, at least one element is selected from the group of Gd, Tb, Dy, Ho, Er, Yb and Lu). If the rare earth element R content is less than 20 wt %, the coercive force Hcj declines markedly because the $R_2Fe_{14}B$ phase, the main phase of the rare earth permanent magnet, is not sufficiently generated, and α-Fe which has soft magnetic properties is precipitated. On the other hand, if the rare earth element R content exceeds 40 wt %, the volume ratio of $R_2Fe_{14}B$ phase, the main phase, declines, thus, lowering the residual magnetic flux density Br. Also, the rare earth element R reacts with oxygen, which causes to increase of the oxygen content, and lowers the amount of R-rich phase that is effective in enhancing the coercive force Hcj. This would result in lowering the coercive force Hcj, and to prevent that, the rare earth element R content is desirable to be set in a range of 20–40 wt %. Since Nd is resourceful, and is relatively inexpensive, Nd may preferably be used as the main composition for rare earth element R. Also, because of its high anisotropic magnetic field, Dy is effective in enhancing the coercive force Hcj. Therefore, Nd and Dy may preferably be selected as the rare earth element R to bring the total weight percentage of Nd and Dy to 31–32.5 wt %. Within this range, the Dy content may preferably be 2–15 wt %, more preferably, 2–12 wt %, and the even more preferably, 4–9 wt %.

Also, the rare earth permanent magnet of the present invention contains 0.5–4.5 wt % of boron B. A high coercive force Hcj cannot be obtained if the boron B content is less than 0.5 wt %. However, if the boron B content exceeds 4.5 wt %, there is a tendency for the residual magnetic flux density Br to decline. Therefore, the upper limit is set at 4.5 wt %. The B content may preferably be 0.5–1.5 wt %, and even more preferably, 0.8–1.2 wt %.

The rare earth permanent magnet of the present invention is based on the finding that the coercive force Hcj can be enhanced while preventing the decline of the residual magnetic flux density Br by containing a specified amount of Bi in the sintered magnet. The Bi content in the sintered magnet is in a range of 0.01–0.2 wt %. The effect in increasing the coercive force Hcj is not enough if the Bi content is less than 0.01 wt %. On the other hand, if the Bi content exceeds 0.2 wt %, the residual magnetic flux density Br declines markedly. The preferred Bi content is 0.02–0.15 wt %, and more preferably, 0.025–0.10 wt %.

As for M, at least one element is selected from the group of Al, Cu, Sn and Ga and the M content ranging from 0.03–0.5 wt %. By adding M as additive within the above range, makes it possible to obtain permanent magnets having a high coercive force, while improving its corrosion resistance and temperature dependency (magnetic properties at elevated temperature). If Al is selected for M, the Al content may preferably be 0.15–0.3 wt %, and more preferably, 0.15–0.25 wt %. If Cu is selected for M, the Cu content may preferably be 0.15 wt % or less (but not 0 wt %), and more preferably, 0.05–0.1 wt %. If Sn is selected for M, the Sn content may preferably be 0.03–0.20 wt %, and more preferably, 0.05–0.15 wt %. If Ga is selected for M, the Ga content may preferably be 0.03–0.20 wt %, and more preferably, 0.05–0.18 wt %.

As for transition metal element T, the elements conventionally used such as Fe, Co and Ni can be used for the rare earth permanent magnet in accordance with the present embodiment. Of these elements, Fe and Co are preferable in consideration of their sintering abilities. Notably from the standpoint of magnetic properties, Fe may preferably be used as the main composition. However, the Curie temperature can be made higher and magnetic properties at elevated temperature enhanced by setting the Co content at 2 wt % or less (but not 0 wt %), more preferably, at 0.1–1.0 wt %, and even more preferably, at 0.3–0.7 wt %.

Hereinafter, descriptions will be made as to a manufacturing method to obtain the rare earth permanent magnet in accordance with a preferred embodiment of the present invention. In the following explanation of the embodiment, a mixing method is employed as a method for manufacturing the rare earth permanent magnet. However, the rare earth permanent magnet of the present invention can also be manufactured by using a so-called single method.

In the present embodiment, the method of manufacturing the permanent magnet will be described using alloy powder "a" (alloy powder for the main phase) that primarily includes $R_2T_{14}B$, alloy powder "b" (alloy powder for the grain boundary phase) with RT as the main composition but also including Bi, and alloy powder "c" (alloy powder for the grain boundary phase) with RT as the main composition and not including Bi. Here, using the alloy powder "c" is optional, and a permanent magnet having a predetermined composition can be obtained without using the alloy powder "c".

In the present specification, "RT" does not mean that R and T are at a ratio of 1:1, but means that this is an alloy of R and T as the main compositions. Also, Bi may be included in the alloy powder "a".

First, the alloys "a", "b" and "c" are obtained by melting and casting the starting raw metal materials in vacuum or an inert gas atmosphere, preferably in an Ar gas atmosphere. As the starting raw material metal, pure rare earth metal, rare earth alloy, pure iron, ferroboron or alloys of these metals can be used. Ingots thus obtained may be subjected to a solution treatment according to necessity if there is a segregation during solidification. As a condition of the solution treatment, the ingot may be maintained in vacuum or in an Ar gas atmosphere for one hour or longer in a temperature range of 700° C. to 1,500° C.

After the "a", "b" and "c" alloys are obtained, the respective master alloys are crushed and pulverized separately. First, the ingots of the respective master alloys are crushed until the particle size becomes several hundred μm. The crushing is performed by a stamp mill, jaw crusher or brown mill, preferably in an inert gas atmosphere. The crushing can be effectively carried out by crushing the ingots after the ingots absorb hydrogen.

The step after the crushing process is the pulverizing process. Jet mills are primarily used for the pulverizing. The crushed particles of several hundred μm in particle size are pulverized until the mean particle size becomes 3 μm to 5 μm. The jet mill may be used to conduct a pulverizing method in which a high-pressure inert gas (such as nitrogen gas) is released through a narrow nozzle to generate a high-speed gas flow to accelerate particles and to further pulverize these particles by colliding the particles against each other, or by blasting them against targets or the container wall.

The finely pulverized "a", "b" and "c" alloy powders are mixed in a nitrogen gas atmosphere. The mixture ratio of "a", "b" and "c" in terms of weight may be about 80 ("a" alloy powder): 20 (the total of "b" alloy powder and "c" alloy powder)—97 ("a" alloy powder): 3 (the total of "b" alloy powder and "c" alloy powder). Here, the above mixture ratios include the case wherein the ratio of "c" alloy powder is zero. The preferable mixture ratio of "a", "b" and "c" in terms of weight may be about 90 ("a" alloy powder): 10 (the total of "b" alloy powder and "c" alloy powder)—97 ("a" alloy powder): 3 (the total of "b" alloy powder and "c" alloy powder).

Adding additives such as zinc stearate of about 0.01–0.3 wt % during the pulverizing process, pulverized powder that can be oriented highly by magnetic field in the compacting step is obtained.

Next, the mixed powder consisting of "a", "b" and "c" alloy powders are filled in a tooling equipped with an electromagnet, such that the alloy powders are compacted in a magnetic field while their crystallographic axis are being oriented by the magnetic field. The compacting in a magnetic field may be conducted in a magnetic field of 800–1500 kA/m and under a pressure of about 130–160 MPa.

After compacting the powder in a magnetic field, a compacted body is then sintered in vacuum or an inert gas atmosphere. While the sintering temperature needs to be adjusted in accordance with the chemical composition, pulverizing methods, the difference in the particle size, particle size distribution and various other conditions, they are sintered for about one to five hours at temperatures between 1,050° C. and 1,130° C. The sintered body is then subjected to an aging treatment. This aging treatment is an important process for controlling the coercive force Hcj. When performing the aging treatment in two stages, it is effective when the sintered body is aged for a predetermined period of time in temperatures around 800° C. and 600° C. When the sintered body is heat treated at temperatures close to 800° C., the coercive force Hcj increases, so this is particularly effective in the mixing method. Also, since the coercive force Hcj increases markedly with heat treatment around 600° C. Therefore, when performing a single-stage aging treatment, the aging treatment may preferably be conducted at temperatures close to 600° C. Thus, a rare earth permanent magnet of the present invention manufactured under the chemical composition and manufacturing method described above may have a residual magnetic flux density Br of 1.25 T or greater and a coercive force Hcj of 1,650 kA/m or greater. Moreover, it can have a residual magnetic flux density of 1.25 T or greater, and a coercive force Hcj of 1,670 kA/m or greater.

Also by adjusting the chemical composition of sintered magnet and the sintering and aging treatment conditions, it is possible to realize a residual magnetic flux density Br of 1.29 T or greater and a coercive force Hcj of 1,750 kA/m or greater, or even a residual magnetic flux density of 1.3 T or greater and a coercive force Hcj of 1,780 kA/m or greater.

And, the product (Br×Hcj) between the residual magnetic flux density Br and the coercive force Hcj can reach 2,100 (T×kA/m) or greater, while the value obtained by dividing the coercive force Hcj by the weight percentage of the heavy rare earth element (Hcj/weight percentage of heavy rare earth element) reaches 230 (kA/m×1/wt %) or greater.

EMBODIMENT EXAMPLES

The present invention will be further explained in detail by presenting specific examples of the embodiment.

Embodiment Example 1

The following preparations were made by subjecting raw material metal to high frequency dissolution in an Ar gas atmosphere.

Alloy "a": (20–30) wt % Nd—(2–10) wt % Dy—(1–1.3) wt % B—(0.1–0.3) wt % Al—bal.Fe Alloy "b": (20–40) wt % Nd—(10–50) wt % Dy—(3–12) wt % Co—(0.5–2) wt % Cu—(0.1–0.5) wt % Al—3 wt % or less (but not 0 wt %) Bi—bal. Fe Alloy "c": (20–40) wt % Nd—(10–50) wt % Dy—(3–12) wt % Co—(0.5–2) wt % Cu—(0.1–0.5) wt % Al—bal. Fe.

Also, the total content of Nd and Dy is 30–60 wt %.

Next, by crushing and pulverizing the alloy "a", the alloy "b", and the alloy "c" under the following conditions, the particle size after pulverizing was about 3 μm to 51 μm. Three kinds of alloy powders were obtained from the alloys "a", "b" and "c". Also, the chemical compositions of the alloys "a", "b" and "c" are appropriately adjusted so that a magnet would be formed with a mixing ratio (weight ratio) of the alloy "a" powder: the alloy powder (b+c) being about 90:10–97:3.

The alloy powders thus obtained were mixed in a "glove box" in a nitrogen gas atmosphere, and the compacting the powders in a magnetic field and sintering were conducted under the following condition. Next, they were subjected to a two-stage aging treatment under the following condition to obtain 12 kinds of sintered magnets, i.e., Samples No. 1–No. 7 and Comparative Examples 1–5. The chemical compositions of the magnets after the sintering process (hereinafter, it may be simply referred to as the "compositions") are shown in Table 1.

Also, the magnets of Sample No. 1, Sample No. 2, Comparative Example 1 and Comparative Example 4 basically have the same composition, except for the Bi contents. Sample No. 3 and Comparative Example 2, Sample No. 4–Sample No. 7 and Comparative Examples 3 and 5 are in the same relation as Samples No. 1 and No. 2 and Comparative Examples 1 and 4. Also, while Samples No. 1–No. 7 and Comparative Example 1–5 are similar in that the total content of Nd+Dy is 31.8 wt %, they differ in terms of the content ratio of Nd and Dy.

Crushing Conditions: Brown mill was used (in which crushing was conducted in a nitrogen gas atmosphere after the ingots absorbed hydrogen).

Pulverizing Conditions: Jet mill was used (which was performed in a high pressure nitrogen gas atmosphere).

Additive agent for crushing: Zinc stearate 0.1 wt %.

Sintering Conditions:

Sample No. 1–Sample No. 3=1,090° C.×4 hours

Comparative Example 1, Comparative Example 2, Comparative Example 4=1,090° C.×4 hours Sample No. 4–Sample No. 7=1,070° C.×4 hours Comparative Example 3, Comparative Example 5=1,070° C.×4 hours Compacting Conditions in a magnetic field: Compacting took place in a horizontal magnetic field of 1,200 kA/m and under a pressure of 147 MPa. (The direction of compression and the direction of the magnetic field intersect at right angle.)

Two-Stage Aging Treatment Conditions:

Sample No. 1, Sample No. 2=750° C.×1 hour, 540° C.×1 hour

Comparative Example 1, Comparative Example 4=750° C.×1 hour, 540° C.×1 hour

Sample No. 3=800° C.×1 hour, 570° C.×1 hour

Comparative Example 2=800° C.×1 hour, 570° C.×1 hour

Sample No. 4–Sample No. 7=800° C.×1 hour, 540° C.×1 hour

Comparative Example 3, Comparative Sample 5=800° C.×1 hour, 540° C.×1 hour

A B—H tracer and a pulse excitation type magnetic properties measuring apparatus (maximum magnetic field generation 7,960 kA/m) were used to measure the residual magnetic flux density Br and coercive force Hcj on Samples No. 1–No. 7 and Comparative Examples 1–3 at room temperature and at 100° C.

The results are shown in Table 2. Table 2 also shows maximum energy product (BH) max at room temperature.

TABLE 1

| No. | Nd (wt %) | Dy (wt %) | Co (wt %) | Cu (wt %) | Al (wt %) | B (wt %) | Bi (wt %) | Fe (wt %) | Sintering Temp. (° C.) |
|---|---|---|---|---|---|---|---|---|---|
| 1 | 22.6 | 9.2 | 0.5 | 0.08 | 0.2 | 1.0 | 0.06 | bal. | 1,090 |
| 2 | 22.6 | 9.2 | 0.5 | 0.08 | 0.2 | 1.0 | 0.15 | bal. | 1,090 |
| 3 | 23.7 | 8.1 | 0.5 | 0.08 | 0.2 | 1.0 | 0.05 | bal. | 1,090 |
| 4 | 27.2 | 4.6 | 0.5 | 0.08 | 0.2 | 1.0 | 0.025 | bal. | 1,070 |
| 5 | 27.2 | 4.6 | 0.5 | 0.08 | 0.2 | 1.0 | 0.05 | bal. | 1,070 |
| 6 | 27.2 | 4.6 | 0.5 | 0.08 | 0.2 | 1.0 | 0.075 | bal. | 1,070 |
| 7 | 27.2 | 4.6 | 0.5 | 0.08 | 0.2 | 1.0 | 0.15 | bal. | 1,070 |
| Comp. Example 1 | 22.6 | 9.2 | 0.5 | 0.08 | 0.2 | 1.0 | — | bal. | 1,090 |
| Comp. Example 2 | 23.7 | 8.1 | 0.5 | 0.08 | 0.2 | 1.0 | — | bal. | 1,090 |
| Comp. Example 3 | 27.2 | 4.6 | 0.5 | 0.08 | 0.2 | 1.0 | — | bal. | 1,070 |
| Comp. Example 4 | 22.6 | 9.2 | 0.5 | 0.08 | 0.2 | 1.0 | 0.30 | bal. | 1,090 |
| Comp. Example 5 | 27.2 | 4.6 | 0.5 | 0.08 | 0.2 | 1.0 | 0.30 | bal. | 1,070 |

TABLE 2

| No. | Bi (wt %) | Dy (wt %) | Magnetic Properties (Room Temp.) Br (T) | Hcj (kA/m) | (BH)max (kJ/m$^3$) | Magnetic Properties (100° C.) Br (T) | Hcj (kA/m) |
|---|---|---|---|---|---|---|---|
| Comp. Example 1 | 0 | 9.2 | 1.17 | 2,380 | 264.3 | 1.07 | 1,504 |
| 1 | 0.06 | 9.2 | 1.16 | 2,468 | 261.9 | 1.06 | 1,568 |
| 2 | 0.15 | 9.2 | 1.15 | 2,420 | 257.1 | 1.05 | 1,552 |
| Comp. Example 2 | 0 | 8.1 | 1.19 | 2,250 | 273.8 | 1.10 | 1,383 |
| 3 | 0.05 | 8.1 | 1.18 | 2,444 | 269.8 | 1.09 | 1,560 |
| Comp. Example 3 | 0 | 4.6 | 1.31 | 1,592 | 328.7 | 1.18 | 724 |
| 4 | 0.025 | 4.6 | 1.31 | 1,783 | 329.5 | 1.18 | 876 |
| 5 | 0.05 | 4.6 | 1.30 | 1,783 | 328.7 | 1.18 | 907 |
| 6 | 0.075 | 4.6 | 1.30 | 1,783 | 325.6 | 1.18 | 907 |
| 7 | 0.15 | 4.6 | 1.30 | 1,767 | 324.0 | 1.18 | 899 |

*Note: Comp. = Comparative, Temp. = Temperature

As shown in Table 1, the chemical composition of Sample No. 1, Sample No. 2 and Comparative Example 1 in terms of sintered magnet is the same except for the fact that Comparative Example 1 does not contain Bi. Here, we will compare the magnetic properties of Sample No. 1, Sample No. 2 and Comparative Example 1 at room temperature, using Table 2.

When one examines the coercive force Hcj at room temperature of Sample No. 1, Sample No. 2 and Comparative Example 1, it is noted that while the coercive force Hcj of Bi-free Comparative Example 1 is 2,380 kA/m. Sample No. 1 with 0.06 wt % of Bi has a higher coercive force Hcj of 2,468 kA/m, and Sample No. 2 with 0.15 wt % of Bi also has a higher coercive force of 2,420 kA/m. In other words, it shows that the coercive force Hcj is enhanced if the magnet includes Bi. However, when the coercive force Hcj of Samples No. 1 and No. 2 are compared, while they show that Bi enhances the coercive force Hcj, it can be assumed that there might be a suitable value for its content.

On the other hand, when one examines the residual magnetic flux density Br at room temperature, Comparative Example 1 without Bi shows a value of 1.17 T, and Sample No. 1 (the Bi content: 0.06 wt %) is 1.16 T, while the residual magnetic flux density Br for Sample No. 2 (the Bi content: 0.15 wt %) is 1.15 T. In other words, even if the Bi content increases, the decline of the residual magnetic flux density Br is just little. Therefore, this shows that it is possible to contain Bi within a scope to hold the decline in the residual magnetic flux density Br to a minimum while enjoying the maximum effects of the enhanced coercive force Hcj.

Also, in the same manner, if Sample No. 3 and Comparative Example 2 are compared, one sees that Sample No. 3 containing the specified amount of Bi at 0.05 wt % in the sintered magnet has a higher coercive force Hcj than that for Comparative Example 2 where the sintered magnet does not include Bi.

Next, when the coercive force Hcj of Samples No. 4–No. 7 and Comparative Example 3, which were equally manufactured excluding the fact concerning the contents of Bi, are compared at room temperature, it is noted that while the coercive force Hcj of Comparative Example 3 is 1,592 kA/m, the coercive force Hcj for Samples No. 4–No. 7 is between 1,767 kA/m and 1,783 kA/m, indicating that the coercive force Hcj of the samples are higher than that of Comparative Example 3 by more than 150 kA/m. Moreover, as we compare the coercive force Hcj of Samples No. 4 to No. 7, it is noted that the coercive force Hcj of these samples are less affected by change in the Bi contents than those of Samples No. 1 to No. 2.

On the other hand, when the residual magnetic flux density Br, at room temperature, is compared, the residual magnetic flux density of Samples No. 4–No. 7 was 1.30–1.31 T, which is generally equal to 1.31 T, the residual magnetic flux density Br of Comparative Example 3. Therefore, from the comparison of Samples No. 4–No. 7 with Comparative Example 3, we learn that Bi is an effective element for enhancing the coercive force Hcj with restraining a decline in residual magnetic flux density Br.

While we have compared the magnetic properties at room temperature of Samples No. 1–No. 7 and Comparative Examples 1–3, the column showing the magnetic properties at 100° C. in Table 2 indicates that even at 100° C., Samples No. 1–No. 7 have a better coercive force Hcj than those of Comparative Examples 1–3, while retaining the residual magnetic flux density Br that is equal to those of Comparative Examples 1–3.

It is understand from the results above that the coercive force Hcj could be enhanced by adding a specified amount of Bi in the sintered magnet.

Next, a preferred range of the Bi content will be verified on the basis of Samples No. 1 and No. 2 and Comparative Examples 1 and 4. Also, as shown in Table 1, Samples No. 1 and No. 2 and Comparative Examples 1 and 4 have been obtained under the same conditions except that the Bi contents were varied.

Figure 1B:
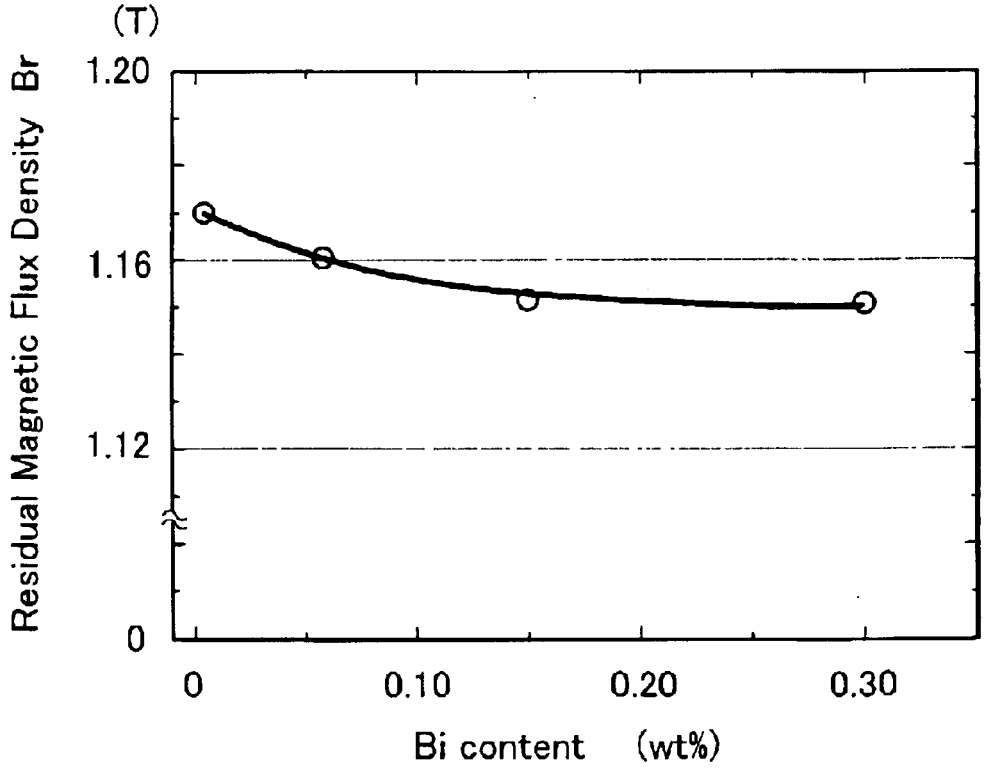

Table 3 shows the measurement results of coercive force Hcj and residual magnetic flux density Br at room temperature and at 100° C. as to Samples No. 1 and No. 2 and Comparative Examples 1 and 4. FIGS. 1(*a*) and (*b*) show the relationship between the change in magnetic properties and the Bi content of Samples No. 1 and No. 2 and Comparative Examples 1 and 4. FIG. 1(*a*) shows the relationship between the Bi content and coercive force Hcj at room temperature while FIG. 1(*b*) shows the relationship between the Bi content and residual magnetic flux density Br at room temperature.

TABLE 3

| | Bi | Dy | Magnetic Properties (Room Temp.) | | | Magnetic Properties (100° C.) | |
|---|---|---|---|---|---|---|---|
| No. | (wt %) | (wt %) | Br (T) | Hcj. (kA/m) | (BH)max (kJ/m$^3$) | Br (T) | Hcj (kA/m) |
| Comp. Example 1 | 0 | 9.2 | 1.17 | 2,380 | 264.3 | 1.07 | 1,504 |
| 1 | 0.06 | 9.2 | 1.16 | 2,468 | 261.9 | 1.06 | 1,568 |
| 2 | 0.15 | 9.2 | 1.15 | 2,420 | 257.1 | 1.05 | 1,552 |
| Comp. Example 4 | 0.30 | 9.2 | 1.15 | 2,285 | 255.5 | 1.05 | 1,449 |

As indicated in FIG. 1(*a*) and Table 3, if the Bi content is from 0 wt % (Comparative Example 1) to 0.06 wt % (Sample No. 1), the coercive force Hcj is improved by about 80 kA/m, but the coercive force Hcj begins to decline gradually, after the Bi content peaks at about 0.07 wt %. And, if the Bi content exceeds 0.20 wt %, the coercive force Hcj declines to about the same level when the Bi content is 0 wt % (Comparative Example 1), and the coercive force Hcj declines to 2,285 kA/m if the Bi content is 0.30 wt % (Comparative Example 4).

Next, FIG. 1(*b*) shows that, if the Bi content increases from 0 wt % (Comparative Example 1) to 0.06 wt % (Sample No. 1) and 0.15 wt % (Sample No. 2), the residual magnetic flux density Br slightly declines. However, in cases where the Bi content is 0.15 wt % (Sample No. 2) or 0.30 wt % (Comparative Example 4), they both show residual magnetic flux density Br of 1.15 T. This shows that the increase of Bi content has minimal effect on the residual magnetic flux density Br.

Therefore, it was learned that by setting the Bi content in sintered magnets at about 0.01–0.20 wt %, it is possible to enhance the coercive force Hcj while restraining the decline of the residual magnetic flux density Br. Moreover, in the chemical composition of Sample No. 1 and Sample No. 2, it is possible to obtain an excellent coercive force Hcj of 2,400 kA/m or greater at room temperature by setting the Bi contents ranging between 0.01 wt % and 0.20 wt %.

Next, a range of desirable Bi content is verified on the basis of Samples No. 4–No. 7 and Comparative Examples 3 and 5 which have different chemical composition from Samples No. 1 and No. 2 and Comparative Examples 1 and 4. As indicated in Table 1, sintered magnets of Samples No. 4–No. 7 and Comparative Examples 3 and 5 were manufactured under the same conditions except for the difference in Bi contents.

Figure 2A:
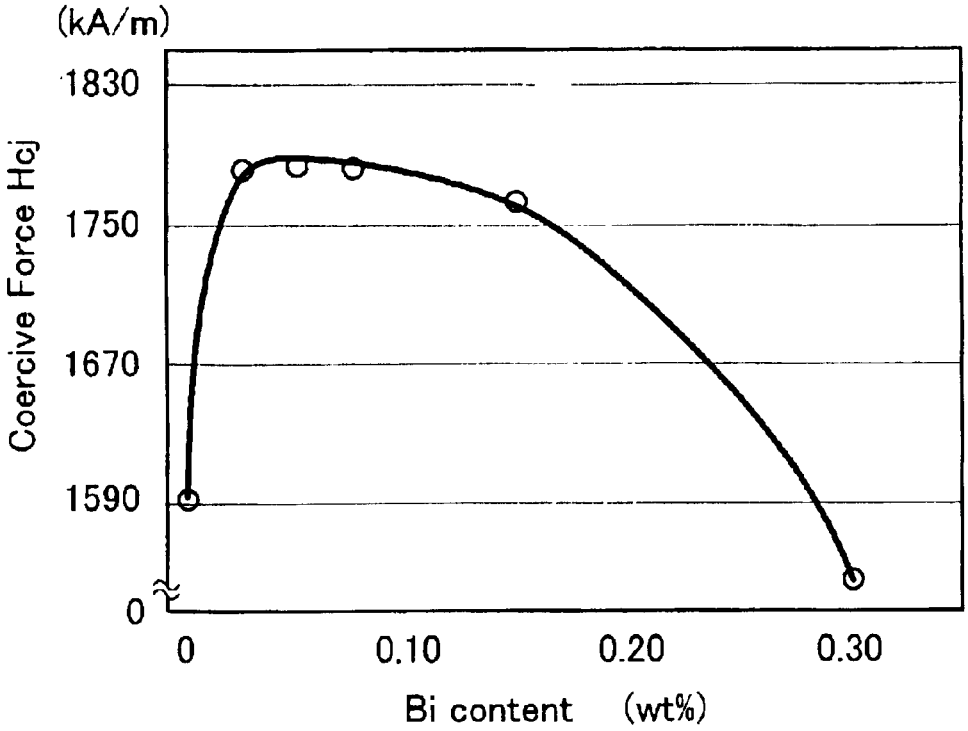
FIG. 2(*a*) is a graph showing the relationship between the Bi content and the coercive force Hcj at room temperature of Samples No. 4–No. 7 and Comparative Examples 3 and 5.
Figure 2B:
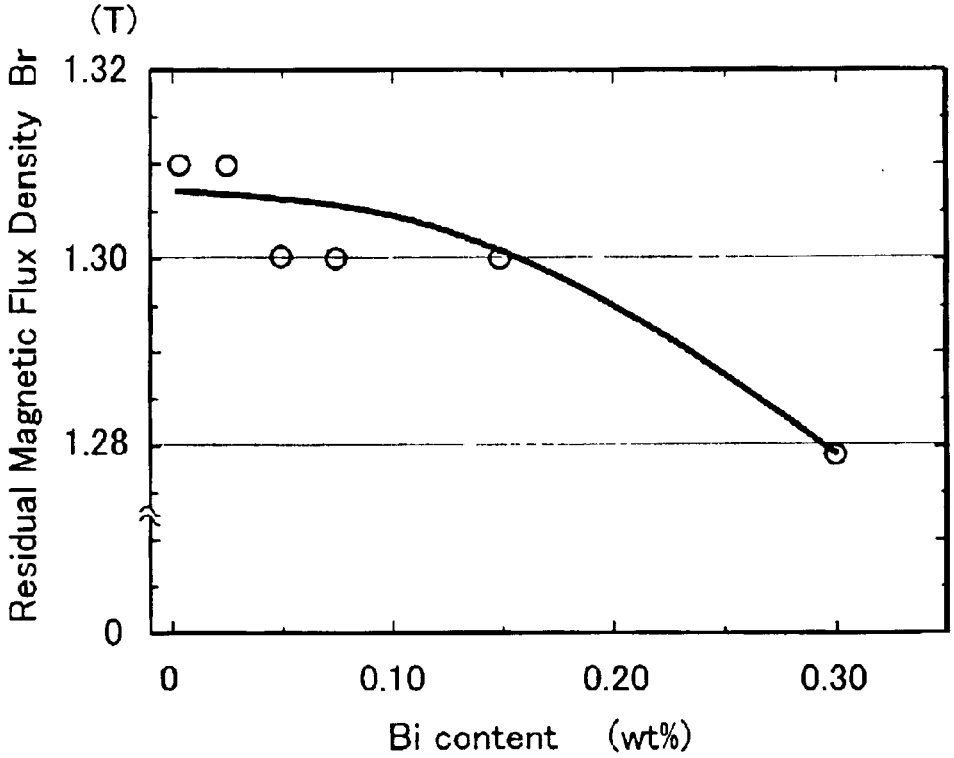

Table 4 shows the measurement results of coercive force Hcj and residual magnetic flux density Br at room temperature and at 100° C. of Samples No. 4–No. 7 and Comparative Examples 3 and 5. FIG. 2 shows the relationship between the Bi content and the change in magnetic properties of Samples No. 4–No. 7 and Comparative Examples 3 and 5. FIG. 2(*a*) shows the relationship between the Bi content and coercive force Hcj at room temperature, and FIG. 2(*b*) shows the relationship between the Bi content and residual magnetic flux density Br at room temperature.

TABLE 4

| No. | Bi (wt %) | Dy (wt %) | Magnetic Properties (Room temperature) Br (T) | Hcj (kA/m) | (BH)max (kJ/m³) | Magnetic Properties (100° C.) Br (T) | Hcj (kA/m) |
|---|---|---|---|---|---|---|---|
| Comp. Example 3 | 0 | 4.6 | 1.31 | 1,592 | 328.7 | 1.18 | 724 |
| 4 | 0.025 | 4.6 | 1.31 | 1,783 | 329.5 | 1.18 | 876 |
| 5 | 0.05 | 4.6 | 1.30 | 1,783 | 328.7 | 1.18 | 907 |
| 6 | 0.075 | 4.6 | 1.30 | 1,783 | 325.6 | 1.18 | 907 |
| 7 | 0.15 | 4.6 | 1.30 | 1,767 | 324.0 | 1.18 | 899 |
| Comp. Example 5 | 0.30 | 4.6 | 1.28 | 1,550 | 316.8 | 1.16 | 652 |

As shown in FIG. 2 and Table 4, while the magnets show excellent residual magnetic flux density Br of 1.31 T when Bi is not included, the coercive force Hcj is low at 1,592 kA/m. In contrast, if the Bi content is 0.025 wt % (Sample No. 4), the residual magnetic flux density Br is 1.31 T and the coercive force Hcj is 1,783 kA/m, both favorable values. The residual magnetic flux density Br and the coercive force Hcj are the same as those of Sample No. 4 (the Bi content: 0.025 wt %), if the Bi content is 0.05 wt % (Sample No. 5) or 0.075 wt % (Sample No. 6). After reaching this peak, the coercive force Hcj begins to gradually decline, and the coercive force Hcj when the Bi content is 0.30 wt % (Comparative Example 5) is 1,550 kA/m, declining below the coercive force Hcj of Comparative Example 3 that does not contain Bi.

From the above results, it was learned that even in Samples No. 4 to No. 7 and Comparative Examples 3 and 5, which differ in chemical composition from Samples No. 1 and No. 2 and Comparative Examples 1 and 4, the coercive force Hcj can be enhanced while restraining the decline of residual magnetic flux density Br by setting the Bi content at between 0.01 wt % and 0.20 wt %. The preferred Bi content ranges from 0.02 wt % to 0.15 wt %, and more preferably between 0.025 wt % and 0.10 wt %. In chemical composition of Samples No. 4–No. 7, it is possible to obtain a favorable magnetic properties of 1.29 T and 1,700 kA/m or greater in coercive force Hcj at room temperature by setting the Bi content at 0.01–0.20 wt %.

Embodiment Example 2

An experiment conducted to verify the changes in magnetic properties resulting from the changes in sintering temperature will be explained here 1as Embodiment Example 2.

As explained above, Samples No. 4–No. 6 and Comparative Example 3 in Embodiment Example 1 were obtained whereby sintering each compacting body which was compacted in a magnetic field for four hours at 1,070° C., and thereafter processing two-stage aging treatment. As indicated in Table 5, the following were obtained in this embodiment example, i.e., Sample No. 8 and Sample No. 9 where only the sintering conditions differ from Sample No. 4 (the Bi content: 0.025 wt %), Sample No. 10 and Sample No. 11 where only the sintering conditions differ from Sample No. 5 (the Bi content: 0.05 wt %), Sample No. 12 and Sample No. 13 where only the sintering conditions differ from Sample No. 6 (the Bi content: 0.075 wt %), Comparative Example 6 and Comparative Example 7 where only the sintering conditions differ from Comparative Example 3 (not containing Bi). The sintering conditions and two-stage aging treatment conditions for Samples No. 8–13, and Comparative Examples 6 and 7 are as follows.

Sintering Conditions:

Samples No. 8, No. 10, No. 12=1,050° C.×4 hours.

Comparative Example 6=1,050° C.×4 hours

Samples No. 9, No. 11, No. 13=1,090° C.×4 hours.

Comparative Example 7=1,090° C.×4 hours

Two-Stage Aging treatment Conditions:

Samples No. 8–No. 13=800° C.×1 hour, 540° C.×1 hour

Comparative Example 6, and 7=800° C.×1 hour, 540° C.×1 hour.

Figure 3:
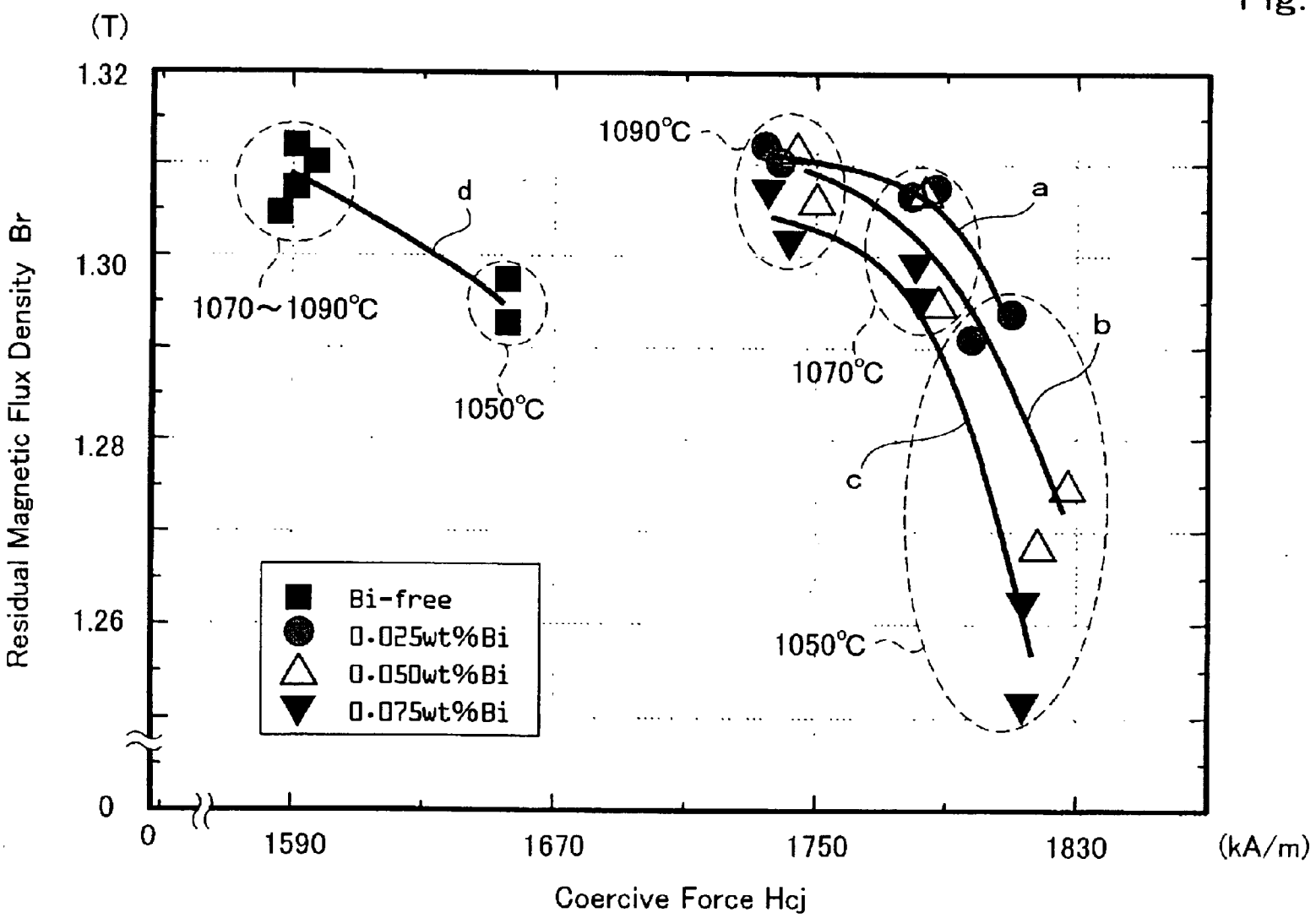
FIG. 3 is a graph showing the relationship between the coercive force Hcj and the residual magnetic flux density Br of Samples No. 4–No. 6, Samples No. 8–No. 13 and Comparative Examples 3, 6 and 7.

FIG. 3 shows the relationship between the coercive force Hcj and the residual magnetic flux density Br of Samples No. 4–No. 6, Samples No. 8–No. 13, Comparative Examples 3, 6 and 7. In FIG. 3, Curve "a" shows the magnetic properties of Samples No. 4, No. 8 and No. 9, whose Bi contents 0.025 wt %, while Curve "b" shows the magnetic properties of Samples No. 5, No. 10 and No. 11, whose Bi contents 0.05 wt %, Curve "c" shows the magnetic properties of Samples No. 6, No. 12 and No. 13, whose Bi contents 0.075 wt %, and Curve "d" shows the magnetic properties of Comparative Example 3, 6 and 7, whose sintered magnets are Bi-free.

TABLE 5

| No. | Nd (wt %) | Dy (wt %) | Co (wt %) | Cu (wt %) | Al (wt %) | B (wt %) | Bi (wt %) | Fe (wt %) | Sintering Temp. (° C.) |
|---|---|---|---|---|---|---|---|---|---|
| 4 | 27.2 | 4.6 | 0.5 | 0.08 | 0.2 | 1.0 | 0.025 | bal. | 1,070 |
| 8 | | | | | | | | | 1,050 |
| 9 | | | | | | | | | 1,090 |
| 5 | 27.2 | 4.6 | 0.5 | 0.08 | 0.2 | 1.0 | 0.05 | bal. | 1,070 |
| 10 | | | | | | | | | 1,050 |
| 11 | | | | | | | | | 1,090 |
| 6 | 27.2 | 4.6 | 0.5 | 0.08 | 0.2 | 1.0 | 0.075 | bal. | 1,070 |
| 12 | | | | | | | | | 1,050 |
| 13 | | | | | | | | | 1,090 |

TABLE 5-continued

| No. | Nd (wt %) | Dy (wt %) | Co (wt %) | Cu (wt %) | Al (wt %) | B (wt %) | Bi (wt %) | Fe (wt %) | Sintering Temp. (° C.) |
|---|---|---|---|---|---|---|---|---|---|
| Comp. Example 3 | 27.2 | 4.6 | 0.5 | 0.08 | 0.2 | 1.0 | 0 | bal. | 1,070 |
| Comp. Example 6 | | | | | | | | | 1,050 |
| Comp. Example 7 | | | | | | | | | 1,090 |

As shown in FIG. 3, Curve "a" is positioned at the upper right of Curve "d". That is, Curve "a" (the Bi content: 0.025 wt %) shows the coercive force Hcj and the residual magnetic flux density Br more favorable than those of Curve "d" (which does not contain Bi) at any sintering temperatures of 1,050° C., 1,070° C. and 1090° C.

Also, Curves "a"–"d" show a tendency of declining coercive force Hcj and increasing residual magnetic flux density Br as the sintering temperature increases. However, it is noteworthy that Curves "a"–"c" with a predetermined Bi content in sintered magnets, show a favorable coercive force Hcj of about 1,750 kA/m even when the sintering temperature is 1,090° C. On the other hand, in Curve "d" which contains no Bi, the coercive force Hcj shows a low value of about 1,590 kA/m when the sintering temperature is 1,090° C.

Next, when Curve "a" (the Bi content: 0.025 wt %), Curve "b" (the Bi content: 0.05 wt %) and Curve "c" (the Bi content: 0.075 wt %) in FIG. 3 are compared, Curve "a" shows the most stable and highest magnetic properties. In Curve "a", favorable residual magnetic flux density Br of 1.29 T or greater and the coercive force Hcj of about 1,750 kA/m are seen even if the sintering temperature is 1,050° C., 1,070° C. or 1,090° C.

It was learned from the above results, with a predetermined Bi content, the magnetic properties are enhanced, and that the decline in coercive force Hcj can be restrained in the event the sintering temperature increases. More specifically, in accordance with the present invention, having a predetermined Bi content, it is possible to obtain a rare earth permanent magnet with a residual magnetic flux density Br of 1.25 T or greater and a coercive force Hcj of 1,670 kA or greater.

Embodiment Example 3

An experiment conducted to compare and verify the changes in magnetic properties against the Bi content and the changes in magnetic properties against the content of Ga in sintered magnets (hereinafter referred to as "Ga content"), will be explained as Embodiment Example 3.

Under the similar conditions as of Embodiment Example 1, alloys of "a", "b" and "c" were prepared, crushed, pulverized, mixed and compacted in a magnetic field. However, in the sintered magnets containing Ga, an alloy containing "5 wt % or less (but not 0 wt %) Ga" was used instead of the alloy containing "3 wt % or less (but not 0 wt %) Bi" in the alloy "b" of Embodiment Example 1.

The compacted bodies compacted in a magnetic field were sintered for four hours at 1,090° C., they were subjected to a two-stage aging treatment under the following conditions. As a result, sintered magnets as Samples No. 14–No. 15 containing Bi and sintered magnets as Comparative Examples 8–10 containing Ga were obtained.

Two-Stage Aging Treatment Conditions:

Samples No. 14–No. 16=750° C.×1 hour, 540° C.×1 hour

Comparative Examples 8–10=750° C.×1 hour, 540° C.×1 hour

The chemical compositions of Samples No. 14–No. 16 and

Comparative Examples 8–10 are shown in Table 6.

Figure 4:
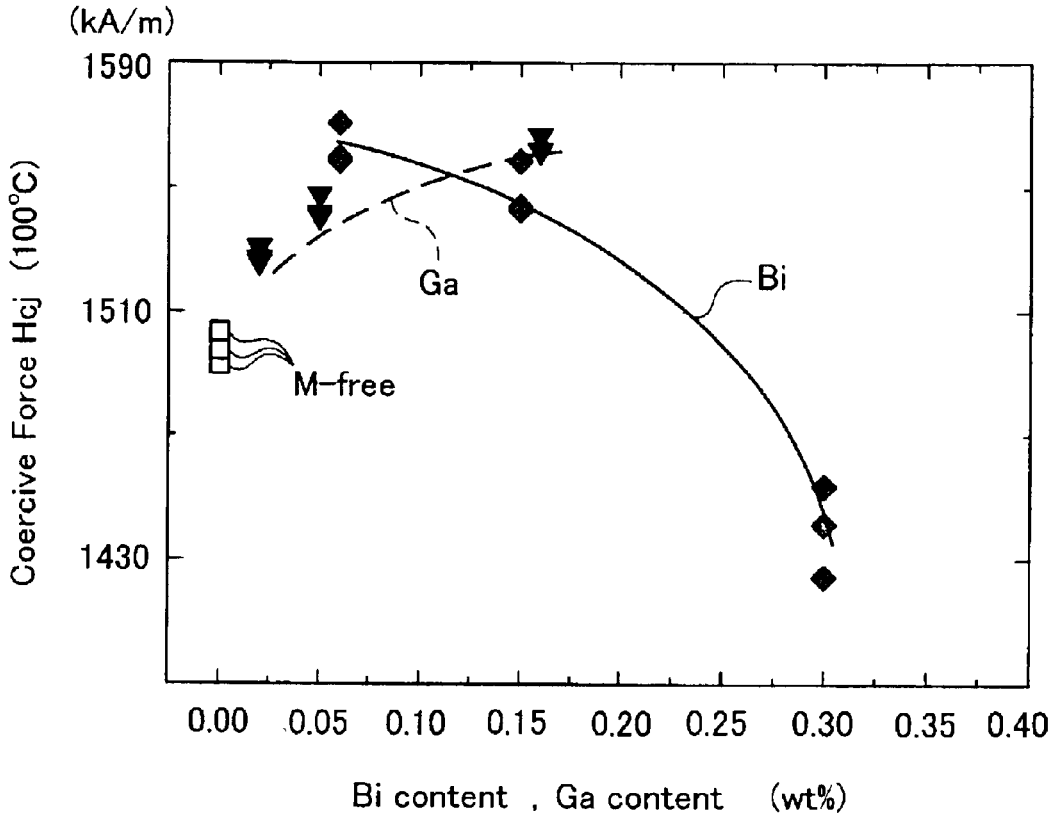
FIG. 4 is a graph showing the coercive force Hcj at 100° C. of Samples No. 14–No. 16 and Comparative Examples 8–10.

FIG. 4 shows the measurement results of coercive force Hcj of Samples No. 14–No. 16 and Comparative Examples 8–10, at 100° C. Also, FIG. 4 shows the coercive force Hcj of sintered magnets wherein neither Ga nor Bi is contained, as "M-free".

TABLE 6

| No. | Nd (wt %) | Dy (wt %) | Co (wt %) | Cu (wt %) | Al (wt %) | B (wt %) | Bi (wt %) | Ga (wt %) | Fe (wt %) |
|---|---|---|---|---|---|---|---|---|---|
| 14 | 22.6 | 9.2 | 0.5 | 0.08 | 0.2 | 1.0 | 0.06 | — | bal. |
| 15 | 22.6 | 9.2 | 0.5 | 0.08 | 0.2 | 1.0 | 0.15 | — | bal. |
| 16 | 22.6 | 9.2 | 0.5 | 0.08 | 0.2 | 1.0 | 0.30 | — | bal. |
| Comp. Example 8 | 22.6 | 9.2 | 0.5 | 0.08 | 0.2 | 1.0 | — | 0.02 | bal. |
| Comp. Example 9 | 22.6 | 9.2 | 0.5 | 0.08 | 0.2 | 1.0 | — | 0.05 | bal. |
| Comp. Example 10 | 22.6 | 9.2 | 0.5 | 0.08 | 0.2 | 1.0 | — | 0.16 | bal. |

As shown in FIG. 4, the coercive force Hcj is about 1,570 kA/m when the Bi content is 0.06 wt % (Sample No. 14). On the other hand, in order to obtain coercive force Hcj equal to this, it is necessary to add about 0.16 wt % of Ga. In other words, it was learned that if Bi is used, a high coercive force Hcj can be obtained with about one third of the Ga content. Therefore, it can be said that the manufacturing cost of magnets can be reduced if Bi is used.

Embodiment Example 4

An experiment conducted to verify the relationship between the magnetic properties and the Dy content, when Bi, Ga and Sn are added individually, is explained as Embodiment Example 4.

Under the similar conditions as Embodiment Example 1, alloys of "a", "b" and "c" were prepared, crushed, pulverized, mixed and compacted in a magnetic field. However, in sintered magnets containing Ga, an alloy containing "5 wt % or less (but not 0 wt %) Ga" was used instead of alloy containing "3 wt % or less (but not 0 wt %) of Bi" in the alloy "b" of Embodiment Example 1.

Also if the sintered magnet contained Sn, an alloy containing "10 wt % or less (but not 0 wt %) Sn" was used instead of "3 wt % or less (but not 0 wt %) Bi" in the alloy "b" explained in Embodiment Example 1.

The compacted bodies compacted in a magnetic field were sintered for four hours at 1,090° C., they were subjected to a two-stage aging treatment under the following conditions. As a result, sintered magnets as Samples No. 17–No. 19 (the Bi content: 0.05 wt %)., as Comparative Example 11–13 (the Ga content: 0.16 wt %), as well as Comparative Examples 14–16 (the Sn content: 0.12 wt %) and Comparative Example 17 that contained none of Bi, Ga or Sn, were obtained.

Two-Stage Aging Treatment Conditions:

Samples No. 17–No. 19=800° C.×1 hour, 570° C.×1 hour

Comparative Example 11–13, Comparative Example 17=800° C.×1 hour, 570° C.×1 hour Comparative Example 14–16=750° C.×1 hour, 540° C.×1 hour.

The chemical compositions of Samples No. 17–No. 19 and Comparative Examples 11–17 are shown in Table 7. Also, as shown in Table 7, Samples No. 17–No. 19 and Comparative Examples 11–17 all contain the same amount of Cu and Al. Therefore, while Comparative Example 17 contains Cu and Al, for the sake of convenience in explaining this Embodiment Example 4, Comparative Example 17 shall be noted that it is "free of M" (M-free in FIG. 5 to be explained later.)

As shown in Table 7, the Dy content in Samples No. 17–No. 19 and Comparative Examples 11–17 are as follows.

Dy content 5.0 wt %: Comparative Example 14

Dy content 6.0 wt %: Comparative Example 15

Dy content 6.3 wt %: Sample No. 17, Comparative Example 11

Dy content 7.2 wt %: Sample No. 18, Comparative Example 12

Dy content 8.1 wt %: Sample No. 19, Comparative Examples 13, 16 and 17

Figure 5:
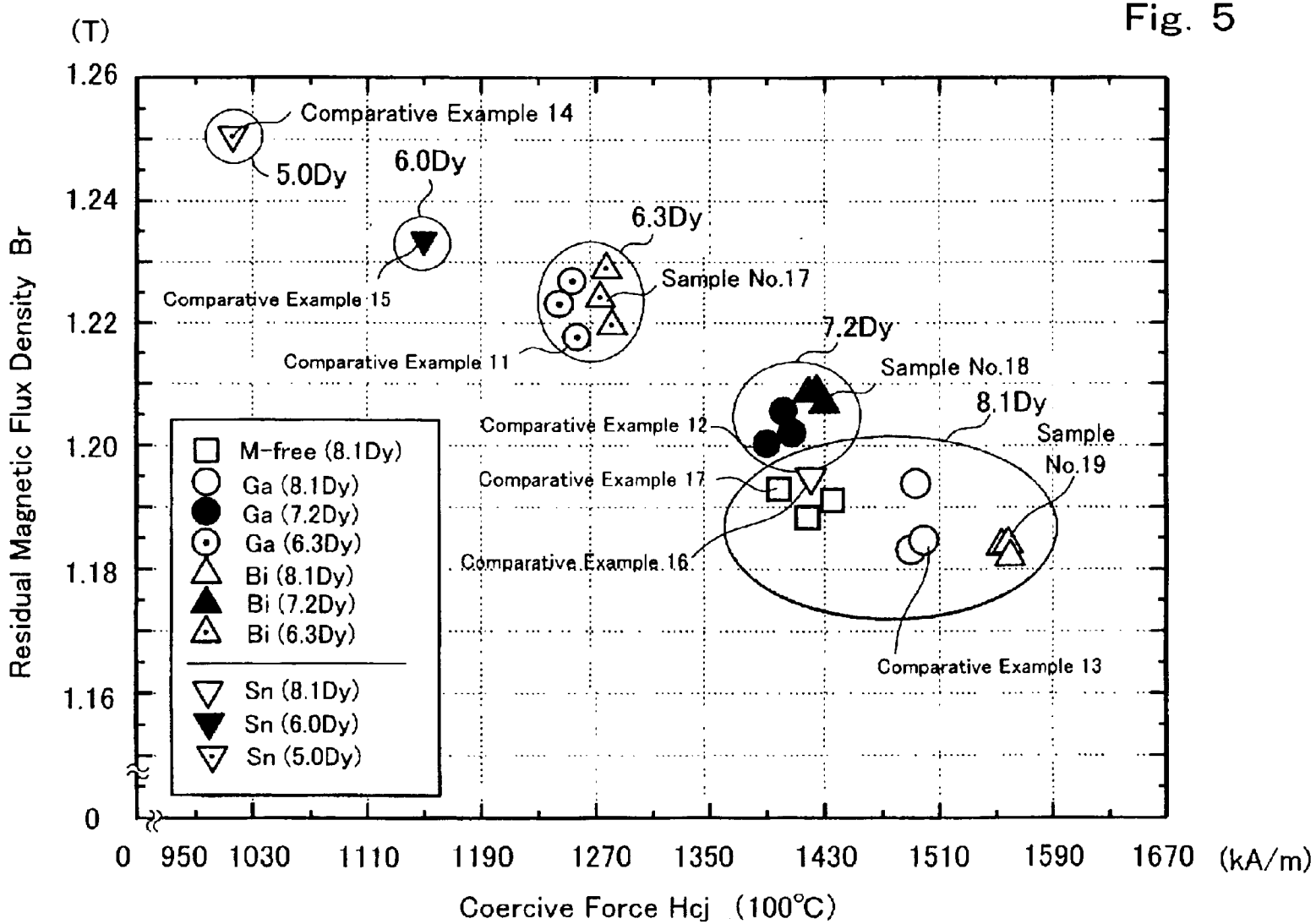
FIG. 5 is a graph showing the measurement results of the coercive force Hcj and residual magnetic flux density Br of Samples No. 17–No. 19 and Comparative Examples 11–17.

The measurement results of coercive force Hcj and residual magnetic flux density Br at 100° C. of Samples No. 17–No. 19 and Comparative Examples 11–17 are shown in FIG. 5.

TABLE 7

| No. | Nd (wt %) | Dy (wt %) | Co (wt %) | Cu (wt %) | Al (wt %) | B (wt %) | Bi (wt %) | Ga (wt %) | Sn (wt %) | Fe (wt %) |
|---|---|---|---|---|---|---|---|---|---|---|
| 17 | 25.5 | 6.3 | 0.5 | 0.08 | 0.2 | 1.0 | 0.05 | — | — | bal. |
| 18 | 24.6 | 7.2 | 0.5 | 0.08 | 0.2 | 1.0 | 0.05 | — | — | bal. |
| 19 | 23.7 | 8.1 | 0.5 | 0.08 | 0.2 | 1.0 | 0.05 | — | — | bal. |
| Comp. Ex. 11 | 25.5 | 6.3 | 0.5 | 0.08 | 0.2 | 1.0 | — | 0.16 | — | bal. |
| Comp. Ex. 12 | 24.6 | 7.2 | 0.5 | 0.08 | 0.2 | 1.0 | — | 0.16 | — | bal. |
| Comp. Ex. 13 | 23.7 | 8.1 | 0.5 | 0.08 | 0.2 | 1.0 | — | 0.16 | — | bal. |
| Comp. Ex. 14 | 26.8 | 5.0 | 0.5 | 0.08 | 0.2 | 1.0 | — | — | 0.12 | bal. |
| Comp. Ex. 15 | 25.8 | 6.0 | 0.5 | 0.08 | 0.2 | 1.0 | — | — | 0.12 | bal. |
| Comp. Ex. 16 | 23.7 | 8.1 | 0.5 | 0.08 | 0.2 | 1.0 | — | — | 0.12 | bal. |
| Comp. Ex. 17 | 23.7 | 8.1 | 0.5 | 0.08 | 0.2 | 1.0 | — | — | — | bal. |

As shown in FIG. 5, the coercive force Hcj increases as the Dy content increases from 5.0 wt %, 6.0 wt %, 6.3 wt %, and 7.2 wt % to 8.1 wt %. On the other hand, there is a tendency for the residual magnetic flux density Br to decline, with the increase of the Dy content. In other words, the Dy content needs only to be increased to obtain a high coercive force Hcj. On the other hand, reducing the Dy content is effective in obtaining a higher residual magnetic flux density Br.

When Sample No. 17 and Comparative Example 11 which contain 6.3 wt % of Dy equally are compared, the residual magnetic flux density Br are respectively 1.22 T and 1.23 T, which are approximately the same. However, Sample No. 17, which contains Bi, shows a higher coercive force Hcj value. Also, when Sample No. 18 and Comparative Example 12 which both have Dy content of 7.2 wt %, are compared, Sample No. 18 has higher values in both residual magnetic flux density Br and coercive force Hcj than those of Comparative Example 12. Therefore, it can be said that by selecting Bi as additive element "M", higher magnetic properties are obtained.

Next, when one examines Sample No. 19, Comparative Examples 13, 16 and 17 which contain 8.1 wt % of Dy, all of these show residual magnetic flux density Br of 1.18 T –1.20 T. As for the coercive force Hcj, however, Sample No.

19 shows the most favorable value at about 1,550 kA/m, followed by Comparative Example 13 at 1,500 kA/m, Comparative Example 17 at about 1,420 kA/m and Comparative Example 16 at about 1,410 kA/m, in that order. That is, of the elements Bi, Ga and Sn used in this Embodiment Example as additive element "M", it can be said that the element that is most effective in enhancing magnetic properties is Bi, followed by Ga and Sn, in that order. Moreover, as the amount of additives for Bi is 0.05 wt %, Ga 0.16 wt % and Sn 0.12 wt %, the Embodiment Examples 1–3 above have proved that Bi exerts the strongest effect in enhancing magnetic properties with the least amount of additive.

Moreover, when Comparative Examples 16 and 17 with the Dy content being 7.2 wt % are compared with Sample No. 18, the latter shows a higher residual magnetic flux density Br than those of Comparative Examples 16 and 17 while maintaining an equal value of coercive force Hcj. That is, while there is a general tendency of coercive force Hcj to decline as the amount of Dy decreases, as explained above, addition of only 0.05 wt % of Bi enhances the magnetic properties while lowering the amount of the costly Dy.

From the above results, it was learned that selecting Bi as an additive is effective in enhancing the magnetic properties, particularly the coercive force Hcj, compared with magnets that do not contain any of Bi, Ga, or Sn, or just containing Ga or Sn as additive element M.

Embodiment Example 5

An experiment verifying the effects of adding both Bi and Ga as additive and Bi and Sn as additive will be explained as Embodiment Example 5.

Under the similar conditions as Embodiment Example 1, alloys of "a", "b" and "c" were prepared, crushed, pulverized and compacted in a magnetic field. However, Ga or Sn was also supplied from the alloy "b". Therefore, when Bi and Ga were both contained, the alloy containing "5 wt % or less (but not 0 wt %) of Ga" was used in addition to the "b" alloy composition of the Embodiment Example 1. Also, when Bi and Sn were both contained, the alloy containing "10 wt % or less (but not 0 wt %) of Sn" was used in addition to the "b" alloy composition of the Embodiment Example 1.

The compacted bodies compacted in a magnetic field were sintered for four hours at 1,090° C., and then subjected to a two-stage aging treatment under the following conditions. As a result, sintered magnets containing Bi and Ga as Sample No. 20 and comparative Example 18, and sintered magnets containing Bi and Sn as Sample No. 12 and Comparative Example 19, were obtained.

Two-Stage Aging Treatment Conditions

Sample No. 20=800° C.×1 hour, 570° C.×1 hour

Comparative Example 18=800° C.×1 hour, 570° C.×1 hour

Sample No. 21=750° C.×1 hour, 540° C.×1 hour

Comparative Example 19=750° C.×1 hour, 540° C.×1 hour

As shown in Table 8, the chemical compositions of Sample No. 20 and Comparative Example 18 are similar to that of Comparative Example 13 used in the above Embodiment Example 4, and the chemical compositions of Samples No. 21 and Comparative Example 19 are similar to those of Sample No. 19 and Comparative Example 16 used in the above Embodiment Example 4. In this Embodiment Example 5, a study will be conducted on the effects in the case Bi and Ga are both used as additive elements M, or in the case Bi and Sn are both used as additive elements M, suitably referring to Sample No. 19, and Comparative Examples 13 and 16.

Figure 6:
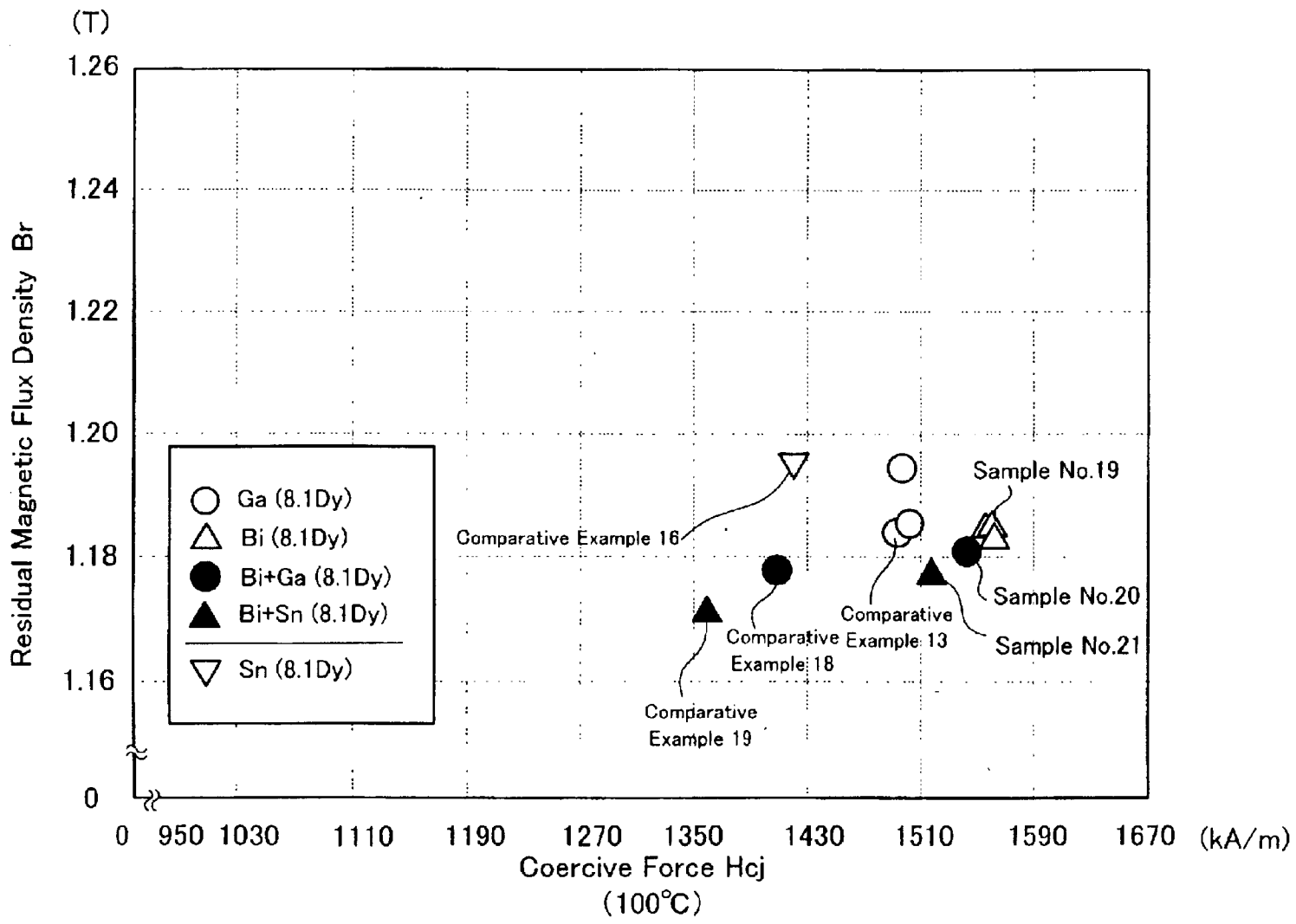
FIG. 6 is a graph showing the measurement results of the coercive force Hcj and residual magnetic flux density Br of Samples No. 19–No. 21 and Comparative Examples 13, 16, 18 and 19.

FIG. 6 shows the coercive force Hcj and residual magnetic flux density Br of Sample No. 20 and Comparative Example 18, which are sintered magnets containing Bi and Ga, and those of Sample No. 21 and Comparative Example 19, which are sintered magnets containing Bi and Sn.

TABLE 8

| No. | Nd (wt %) | Dy (wt %) | Co (wt %) | Cu (wt %) | Al (wt %) | B (wt %) | Bi (wt %) | Ga (wt %) | Sn (wt %) | Fe (wt %) |
|---|---|---|---|---|---|---|---|---|---|---|
| 19 | 23.7 | 8.1 | 0.5 | 0.08 | 0.2 | 1.0 | 0.05 | — | — | bal. |
| 20 | 23.7 | 8.1 | 0.5 | 0.08 | 0.2 | 1.0 | 0.05 | 0.16 | — | bal. |
| Comp. Exp. 18 | 23.7 | 8.1 | 0.5 | 0.08 | 0.2 | 1.0 | 0.30 | 0.16 | — | bal. |
| Comp. Exp. 13 | 23.7 | 8.1 | 0.5 | 0.08 | 0.2 | 1.0 | — | 0.16 | — | bal. |
| 21 | 23.7 | 8.1 | 0.5 | 0.08 | 0.2 | 1.0 | 0.05 | — | 0.12 | bal. |
| Comp. Exp. 19 | 23.7 | 8.1 | 0.5 | 0.08 | 0.2 | 1.0 | 0.35 | — | 0.12 | bal. |
| Comp. Exp. 16 | 23.7 | 8.1 | 0.5 | 0.08 | 0.2 | 1.0 | — | — | 0.12 | bal. |

First, a comparison will be made between Sample No. 20 (the Bi content: 0.05 wt %, the Ga content: 0.16 wt %) and Comparative Example 13 (the Ga content: 0.16 wt %). The chemical compositions of Comparative Example 13 and Sample No. 20 are the same except for the fact that Sample No. 20 contains 0.05 wt % of Bi.

FIG. 6 shows that Sample No. 20, which contains Bi and Ga as additives, is located on the right side of Comparative Example 13 which includes only additive Ga, and that Sample No. 20 has a coercive force Hcj that is about 50 kA/m higher than that of Comparative Example 13.

Therefore, adding Ga and the specified amount of Bi, makes the coercive force Hcj higher than that of the magnet containing Ga only. However, Comparative Example 18 which contains 0.30 wt % of Bi and 0.16 wt % of Ga, showed a coercive force Hcj about 100 kA/m lower than that of Comparative Example 13; and residual magnetic flux density Br of Comparative Example 18 also was lower than that of Comparative Example 13.

The above results show that, while it is possible to enhance the coercive force Hcj by adding Ga and a specified amount of Bi, even in this case the recommended amount of Bi additives is assumed between 0.01 wt % and 0.2 wt %.

Next, a comparison is made between Sample No. 21 (the Bi content: 0.05 wt %, the Sn content: 0.12 wt %) and Comparative Example 16 (the Sn content: 0.12 wt %). The chemical compositions of Comparative Example 16 and Sample No. 12 are similar except for the fact that Sample 21 contains 0.05 wt % of Bi.

FIG. 6 shows that Sample No. 21, which contains additives Bi and Sn, has a coercive force Hcj about 100 kA/m higher than that of Comparative Example 16 having only Sn as additive. However, in case of Comparative Example 19 (the Bi content: 0.35 wt %, the Sn content: 0.12 wt %), the coercive force Hcj thereof was about 1,360 kA/m. That is, Comparative Example 19 shows a coercive force lower than that of Comparative Example 16 (coercive force Hcj: about 1,420 kA/m) which contains only Sn as additive. When Comparative Example 19 is compared with Sample No. 21 (coercive force Hcj: about 1,520 kA/m), its coercive force is lower than that of Sample No. 21, by 150 kA/m or greater. Also, Comparative Example 19 (the Bi content: 0.35 wt %, the Sn content: 0.12 wt %) is located at the lower left of Comparative Example 13 (the Ga content: 0.16 wt %) and Sample No. 21 (the Bi content: 0.05 wt %, the Sn content: 0.12 wt %). It shows that Comparative Example 19 with 0.35 wt % of Bi has a lower residual magnetic flux density Br than those of Comparative Example 13 and Sample No. 21.

From the above results, it was verified that while the coercive force Hcj can be enhanced by adding a specified amount of Bi and Sn, even in this case, if the amount of Bi exceeds the specified amount, the magnetic properties will be lowered than the case wherein only Sn was added. Therefore, it can be said that, even when adding both Bi and Sn, the amount of Bi is preferably between 0.01 wt % and 0.2 wt %.

FIG. 6 shows the magnetic properties of Sample No. 19 used in the above Embodiment Example 4. When Samples No. 19 (the Bi content: 0.05 wt %), No. 20 (the Bi content: 0.05 wt %, the Ga content: 0.16 wt %) and No. 21 (the Bi content: 0.05 wt %, the Sn content: 0.12 wt %) are examined, it can be seen that the magnetic properties improve in the order of Samples No. 19, No. 20 and No. 21. That is, the results of this Embodiment Example can be summarized as follows: That the best magnetic properties were seen in Sample 19 which contains only Bi as additive (however, when Bi is contained, the Bi content shall be between 0.01 wt % and 0.2 wt %), followed by Sample No. 20 which contains Bi and Ga, Sample No. 21 which contains Bi and Sn, Comparative Example 13 which contains only Ga and Comparative Example 16 which contains only Sn. From these results, it became evident that the sintered magnets wherein a small amount of Bi is contained in the range of 0.01–0.2 wt %, as the present invention recommends, have excellent magnetic properties.

Embodiment Example 6

The sintered magnets used in Embodiment Examples 1–5 all contained the specified amount of Al and Cu. This Embodiment Example 6 was performed to verify whether or not the magnetic properties of the sintered magnets can be improved by adding the specified amount of Bi in the sintered magnets even if the magnets do not contain Al and Cu.

The following alloys were prepared by melting starting raw material metals at high frequency under an Ar gas atmosphere.

Alloy "d": (20–30) wt % Nd—(2–10) wt % Dy—(1–1.3) wt % B—bal. Fe

Alloy "e": (20–40) wt % Nd—(10–50) wt % Dy—(3–12) wt % Co—3 wt % or less (but not 0 wt %) Bi—bal. Fe Alloy "f": (20–40) wt % Nd—(10–50) wt % Dy (3–12) wt % Co—bal. Fe Also, the total amount of Nd and Dy is between 30 wt % and 60 wt %.

Next, alloys "d", "e" and "f" were crushed and pulverized under the following conditions, the particle size after pulverizing was between 3 $\mu$m and 5 $\mu$m. Three kinds of alloy powders, "d", "e" and "f" were obtained from the alloys "d", "e" and "f". Also, the chemical compositions of the alloys "d", "e" and "f" are appropriately adjusted so that a magnet would be formed with a mixing ratio (weight ratio) of the alloy "d" powder: the alloy powder (e+f) being about 90:10–97:3.

The alloy powders thus obtain were mixed within a "glove box" under a nitrogen gas atmosphere, and compacted in a magnetic field and sintered under the following conditions. Next, a two-stage aging treatment was conducted under the following conditions to obtain sintered magnets as Samples No. 22 and No. 23 and Comparative Examples 20 and 21. The chemical compositions after the sintering process are shown in Table 9. Generally, they all have the same composition except for the Bi contents. Also, to make comparisons more convenient, Table 9 shows the chemical compositions of Samples No. 1 and No. 2 and Comparative Examples 1 and 4 obtained in Embodiment Example 1. Sample No. 22 and Sample No. 1 have the same composition except for the fact that Sample No. 22 does not contain Cu and Al. Also, Samples No. 23 and No. 2, Comparative Examples 20 and 1, Comparative Examples 21 and 4 are in the same relationship as Sample No. 22 and No. 1

Crushing Conditions: Brown mill was used (in which crushing was conducted in a nitrogen gas atmosphere after the ingots absorbed hydrogen).

Pulverizing Conditions: Jet mill was used (which was performed in a high pressure nitrogen gas atmosphere).

Additive agent for crushing: Zinc stearate 0.1 wt %.

Sintering Conditions:

Sample No. 22, Sample No. 23=1,090° C.×4 hours
Comparative Example 20, Comparative Example 21=1,090° C.×4 hours Compacting Conditions in a magnetic field: Compacting took place in a horizontal magnetic field of 1200 kA/m and under a pressure of 147 MPa. (The direction of compression and the direction of the magnetic field intersect at right angle.)

Two-Stage Aging Treatment Conditions:

Samples No. 22 and No. 23=750° C.×1 hour, 540° C.×1 hour

Comparative Examples 20 and 21: 750° C.×1 hour, 540° C.×1 hour

The B—H tracer and the pulse excitation type magnetic properties measuring apparatus (maximum magnetic field generation 7,960 kA/m) were used to measure the residual magnetic flux density Br and coercive force Hcj on Samples No. 22 and No. 23 and Comparative Examples 20 and 21 at room temperature and at 100° C.

The results are shown in Table 10. Table 10 also shows maximum energy product (BH) max at room temperature.

To facilitate comparison, Table 10 also shows the maximum energy product (BH) max at room temperature and the residual magnetic flux density Br, the coercive force Hcj at room temperature and at 100° C. of Samples No. 1 and No. 2 and Comparative Examples 1 and 4.

TABLE 9

| No. | Nd (wt %) | Dy (wt %) | Co (wt %) | Cu (wt %) | Al (wt %) | B (wt %) | B (wt %) | Fe (wt %) | Sintering Temp. (° C.) |
|---|---|---|---|---|---|---|---|---|---|
| 1 | 22.6 | 9.2 | 0.5 | 0.08 | 0.2 | 1.0 | 0.06 | bal. | 1,090 |
| 22 | 22.6 | 9.2 | 0.5 | — | — | 1.0 | 0.06 | bal. | 1,090 |
| 2 | 22.6 | 9.2 | 0.5 | 0.08 | 0.2 | 1.0 | 0.15 | bal. | 1,090 |
| 23 | 22.6 | 9.2 | 0.5 | — | — | 1.0 | 0.15 | bal. | 1,090 |
| Comp. Exam. 1 | 22.6 | 9.2 | 0.5 | 0.08 | 0.2 | 1.0 | — | bal. | 1,090 |
| Comp. Exam. 20 | 22.6 | 9.2 | 0.5 | — | — | 1.0 | — | bal. | 1,090 |
| Comp. Exam. 4 | 22.6 | 9.2 | 0.5 | 0.08 | 0.2 | 1.0 | 0.30 | bal. | 1,090 |
| Comp. Exam. 21 | 22.6 | 9.2 | 0.5 | — | — | 1.0 | 0.30 | bal. | 1,090 |

TABLE 10

| No. | Bi (wt %) | Dy (wt %) | Magnetic Properties (Room Temp.) Br (T) | Hcj (kA/m) | (BH)max (kJ/ m³) | Magnetic Properties (100° C.) Br (T) | Hcj (kA/m) |
|---|---|---|---|---|---|---|---|
| Comp. Example 1 | 0 | 9.2 | 1.17 | 2,380 | 264.3 | 1.07 | 1,504 |
| 1 | 0.06 | 9.2 | 1.16 | 2,468 | 261.9 | 1.06 | 1,568 |
| 2 | 0.15 | 9.2 | 1.15 | 2,420 | 257.1 | 1.05 | 1,552 |
| 22 | 0.06 | 9.2 | 1.17 | 2,452 | 263.7 | 1.07 | 1,562 |
| 23 | 0.15 | 9.2 | 1.16 | 2,408 | 260.2 | 1.06 | 1,546 |
| Comp. Exam. 20 | 0 | 9.2 | 1.17 | 2,352 | 261.8 | 1.07 | 1,492 |
| Comp. Exam. 21 | 0.30 | 9.2 | 1.15 | 2,260 | 253.9 | 1.05 | 1,390 |
| Comp. Exam. 4 | 0.30 | 9.2 | 1.15 | 2,285 | 255.5 | 1.05 | 1,449 |

As shown in Table 9, Samples No. 22, No. 23, Comparative Examples 20 and 21 have the same chemical composition except for the fact that Comparative Example 20 does not contain Bi. Here, a comparison will be made on the magnetic properties among Samples No. 22, No. 23, Comparative Examples 20 and 21 at room temperature using Table 10.

As for the coercive force Hcj of Samples No. 22, 23 and Comparative Examples 20 and 21 at room temperature, the coercive force of Comparative Example 20, that is Bi-free, is 2,352 kA/m, while Sample 22 with 0.06 wt % of Bi has a favorable coercive force of 2,452 kA/m and Sample 23 with 0.15 wt % of Bi has also a favorable coercive force of 2,408 kA/m. However, the coercive force Hcj of Comparative Example 21 with 0.30 wt % of Bi is 2,260 kA/m, which is lower than that of Comparative Example 20 that is Bi-free. In other words, while the coercive force Hcj increases with the addition of Bi, it was learned that the coercive force declines when the Bi content exceeds a specified amount.

Figure 7A:
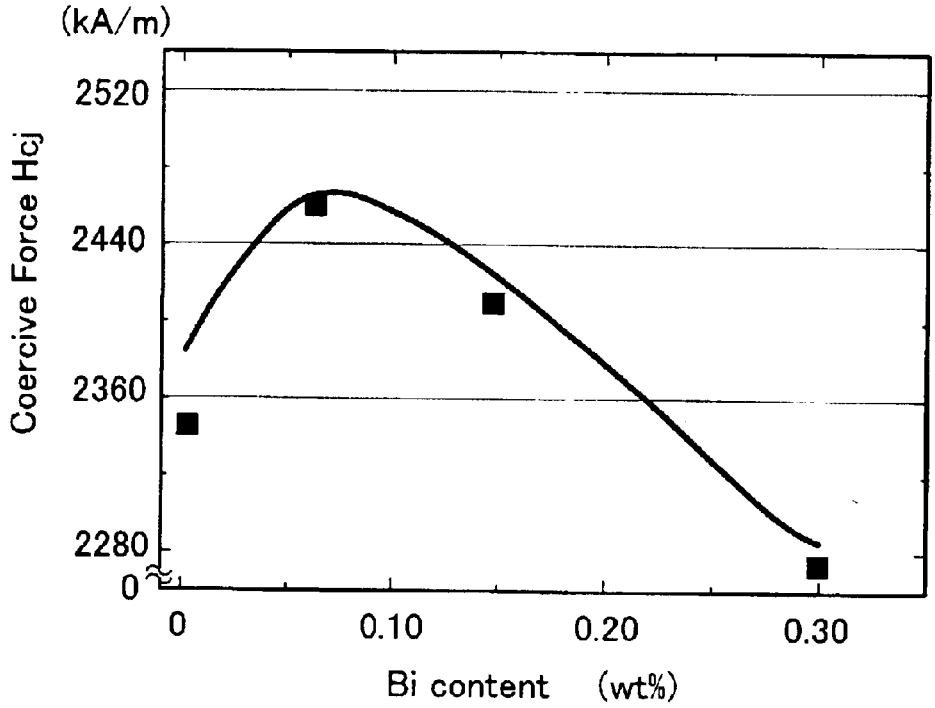
FIG. 7(*a*) is a graph showing the coercive force Hcj at room temperature of Samples No. 22 and No. 23, and Comparative Examples 20 and 21.
Figure 7A:
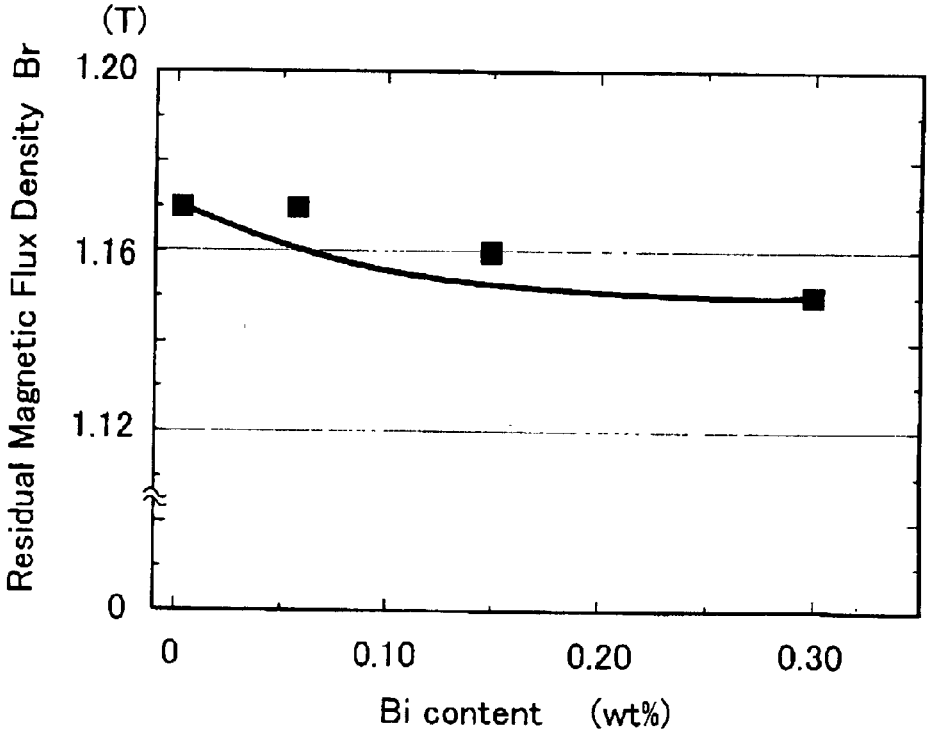

As explained above, the chemical compositions of Samples No. 22, No. 23 and Comparative Examples 20 and 21 correspond to those of Samples No. 1 and No. 2 and Comparative Examples 1 and 4 except for the fact that Samples 22 and 23 and Comparative Examples 20 and 21 are free of Cu and Al. Here, the results of Table 10 explained above, that is, the coercive force Hcj of Samples No. 22, No. 23, Comparative Examples 20 and 21 at room temperature are shown in FIG. 7. It is noted that the curve indicated in FIG. 7 is the same curve shown in FIG. 1(*a*). As shown in FIG. 7, Samples No. 22 and No. 23, Comparative Examples 20 and 21 are plotted along the curved line. Therefore, even in the event the sintered magnets are free of Cu and Al, it is clear that the coercive force Hcj can be improved by adding a specified amount of Bi.

Next, the residual magnetic flux density Br, at room temperature, of Samples No. 22 and No. 23 and Comparative Examples 20 and 21 shown in Table 10 will be examined. The residual magnetic flux density Br of Bi-free Comparative Example 20 is 1.17 T, while that of Sample No. 22 (the Bi content: 0.06 wt %) is 1.17 T, and that for Sample 23 (the Bi content: 0.15 wt %) is 1.16 T and that of Comparative Example 21 (the Bi content: 0.30 wt %) is 1.15 T. In other words, if Bi is added within the range of 0.01–0.2 wt %, in accordance with the embodiment of the present invention, it can be said that there is virtually no decline in residual magnetic flux density Br.

As explained above, even in the event the sintered magnet does not include Cu or Al, that is, if the magnet is free of such "M" elements as Cu, Al, Sn or Ga, the same tendency as Embodiment Example 1, was obtained by adding a specified amount of Bi. That is, by containing Bi in the sintered magnets within the preferred range of 0.01 to 0.2 wt % in accordance with the present invention, it was learned that the coercive force Hcj can be enhanced with restraining a decline in residual magnetic flux density Br, even if the magnet does not include other elements as "M". If the Bi content in the magnets within this range, it is possible to obtain the coercive force Hcj of 2,400 kA/m or greater and the residual magnetic flux density Br of 1.16 T or greater.

Through Embodiment Examples 1–6, it became clear that the coercive force Hcj can be enhanced with restraining a decline in residual magnetic flux density Br by containing 0.01–0.2 wt % of Bi in the sintered magnet. Table 1 here shows the product between the residual magnetic flux density Br and the coercive force Hcj (Br×Hcj), and the value obtained by dividing the coercive force Hcj by the weight percentage of heavy rare earth element (Hcj/weight percentage of heavy rare earth element) as to Samples 1–No. 7, Samples No. 22 and No. 23 that were obtained in Embodiment Examples 1 and 6. Also, as Dy is the only heavy rare earth element in Samples No. 1–No. 7. Samples No. 22 and No. 23, the value obtained by dividing the coercive force Hcj by the weight percentage of heavy rare earth element (Hcj/weight percentage of the heavy rare earth element) is shown as "Hcj/Dy content" in Table 11.

TABLE 11

| No. | Bi (wt %) | Dy (wt %) | Magnetic Properties (Room Temperature) Br (T) | Hcj (kA/m) | Br × Hcj (T · kA/m) | Hcj/Dy Content (kA/m · 1/wt %) |
|---|---|---|---|---|---|---|
| 1 | 0.06 | 9.2 | 1.16 | 2,468 | 2,862 | 268 |
| 2 | 0.15 | 9.2 | 1.15 | 2,420 | 2,783 | 263 |
| 3 | 0.05 | 8.1 | 1.18 | 2,444 | 2,884 | 302 |
| 4 | 0.025 | 4.6 | 1.31 | 1,783 | 2,336 | 388 |
| 5 | 0.05 | 4.6 | 1.30 | 1,783 | 2,318 | 388 |
| 6 | 0.075 | 4.6 | 1.30 | 1,783 | 2,318 | 388 |
| 7 | 0.15 | 4.6 | 1.30 | 1,767 | 2,297 | 384 |
| 22 | 0.06 | 9.2 | 1.17 | 2,452 | 2,869 | 267 |
| 23 | 0.15 | 9.2 | 1.16 | 2,408 | 2,793 | 262 |

The column for the product between the residual magnetic flux density Br and the coercive force Hcj (Br×Hcj) in Table 11 shows favorable values of 2,200 (T×kA/m) or greater as to Samples No. 1–No. 7 and Samples No. 22 and No. 23.

Also, the Hcj/Dy content column shows that Samples No. 1–No. 7 and Samples No. 22 and No. 23 all have values of 260 (kA/m×1/wt %) or greater and Samples No. 3–No. 7 have values of 290 (kA/m×1/wt %) or greater. What is noteworthy here is that Samples No. 4–No. 7 which have Dy contents of 4.6 wt %, indicate excellent values of 384–388 (kA/m×1/wt %). That is, according to the present invention that calls for a specified amount of Bi in sintered magnets, one can obtain a rare earth permanent magnet with excellent magnetic properties while lowering the additive amount of costly heavy rare earth elements.

Next, the values obtained by dividing coercive force Hcj by the weight percentage of Bi (Hcj/weight percentage of Bi) are shown in Table 12 as to Samples No. 1–No. 7, Samples No. 22 and No. 23, Comparative Examples 4, 5 and 21, which were obtained in Embodiment Examples 1 to 6.

TABLE 12

| No. | Bi (wt %) | Magnetic Properties (Room Temperature) Hcj (kA/m) | Hcj/Bi Content (kA/m·1/wt %) |
|---|---|---|---|
| 1 | 0.06 | 2,468 | 41,127 |
| 2 | 0.15 | 2,420 | 16,132 |
| 3 | 0.05 | 2,444 | 48,874 |
| 4 | 0.025 | 1,783 | 71,322 |
| 5 | 0.05 | 1,783 | 35,661 |
| 6 | 0.075 | 1,783 | 23,774 |
| 7 | 0.15 | 1,767 | 11,781 |
| 22 | 0.06 | 2,452 | 40,867 |
| 23 | 0.15 | 2,408 | 16,053 |
| Comp. Example 4 | 0.30 | 2,285 | 7,615 |

TABLE 12-continued

| No. | Bi (wt %) | Magnetic Properties (Room Temperature) Hcj (kA/m) | Hcj/Bi Content (kA/m·1/wt %) |
|---|---|---|---|
| Comp. Example 5 | 0.30 | 1,550 | 5,167 |
| Comp. Example 21 | 0.30 | 2,260 | 7,533 |

Table 12 shows that Comparative Examples 4, 5 and 21, with the Bi content being 0.30 wt %, have values obtained by dividing the coercive force Hcj by the weight percentage of Bi between 5,167 (kA/m×1/wt %) and 7,615 (kA/m×1/wt %). On the other hand, Samples No. 1–No. 7 and Samples No. 22 and No. 23, with the Bi content being 0.01–0.2 wt %, which is a preferred range in accordance with the embodiment of the present invention, show values obtained by dividing the coercive force Hcj by the weight percentage of Bi of 10,000 or greater in each case.

What is noteworthy is that Samples No. 1, Samples No. 3–No. 6 and Samples No. 22 where the Bi content is less than 0.1 wt % show values of 20,000 or greater (kA/m×1/wt %). In other words, by containing a specified amount of Bi in the sintered magnets, which is between 0.01 wt % and 0.2 wt % in a preferred embodiment of the present invention, the magnets can enjoy the maximum effects of the enhanced coercive force Hcj with the addition of Bi.

Embodiment Example 7

In the Embodiment Examples 1–6, the sintered magnets were obtained by employing a so-called mixing method wherein three kinds of alloys were used as the raw material metal. This Embodiment Example 7 was performed to verify the magnetic properties of the sintered magnets, which were obtained by employing a so-called single method.

Alloy "g" was prepared so as to include all the elements of the desirable sintered magnet, by employing the single method. Under the same conditions as Sample No. 1, the alloy "g" was crushed, pulverized and compacted in a magnetic field. The compacting bodies compacted in a magnetic field were sintered for four hours at 1,090° C., and then subjected to a two-stage aging treatment, also under the same conditions as Sample No. 1. As a result, a sintered magnet as Sample No. 24 was obtained.

Table 13 shows the chemical composition of Sample No. 24, and Table 14 shows the magnetic properties of Sample No. 24. To facilitate comparison, Table 13 also shows the chemical composition of Sample No. 1, and Table 14 also shows the magnetic properties of Sample No. 1.

TABLE 13

| No. | Nd (wt %) | Dy (wt %) | Co (wt %) | Cu (wt %) | Al (wt %) | B (wt %) | Bi (wt %) | Fe (wt %) | Sintering Temp. (° C.) |
|---|---|---|---|---|---|---|---|---|---|
| 1 | 22.6 | 9.2 | 0.5 | 0.08 | 0.2 | 1.0 | 0.06 | bal. | 1,090 |
| 24 | 22.6 | 9.2 | 0.5 | 0.07 | 0.2 | 1.0 | 0.07 | bal. | 1,090 |

TABLE 14

| No. | Br (T) | Hcj (kA/m) | (BH)max (kJ/m³) |
|---|---|---|---|
| | Magnetic Properties (Room Temp.) | | |
| 1 | 1.16 | 2,468 | 261.9 |
| 24 | 1.15 | 2,495 | 260.0 |

As shown in Table 13, Samples No. 1 and No. 24 have the almost same chemical composition. Also, as shown in Table 14, the magnetic properties of Samples No. 1 are equal to those of Samples No. 24.

Therefore, whether the raw material alloy is one kind or more, does not influence the magnetic properties of the sintered magnets. In other words, the single method can be also employed to obtain the sintered magnets of the present invention, as well as the mixing method. Employing the mixing method leads to easiness in adjusting the predetermined chemical composition. On the other side, the single method has an advantage in cost reduction since the single method does not need mixing process.

Embodiment Example 8

Embodiment Example 8 shows the results of line segment analysis using Electron Probe Micro Analyzer (EPMA) to verify the position of Bi in the sintered magnet, using Sample No. 1.

Figure 8:
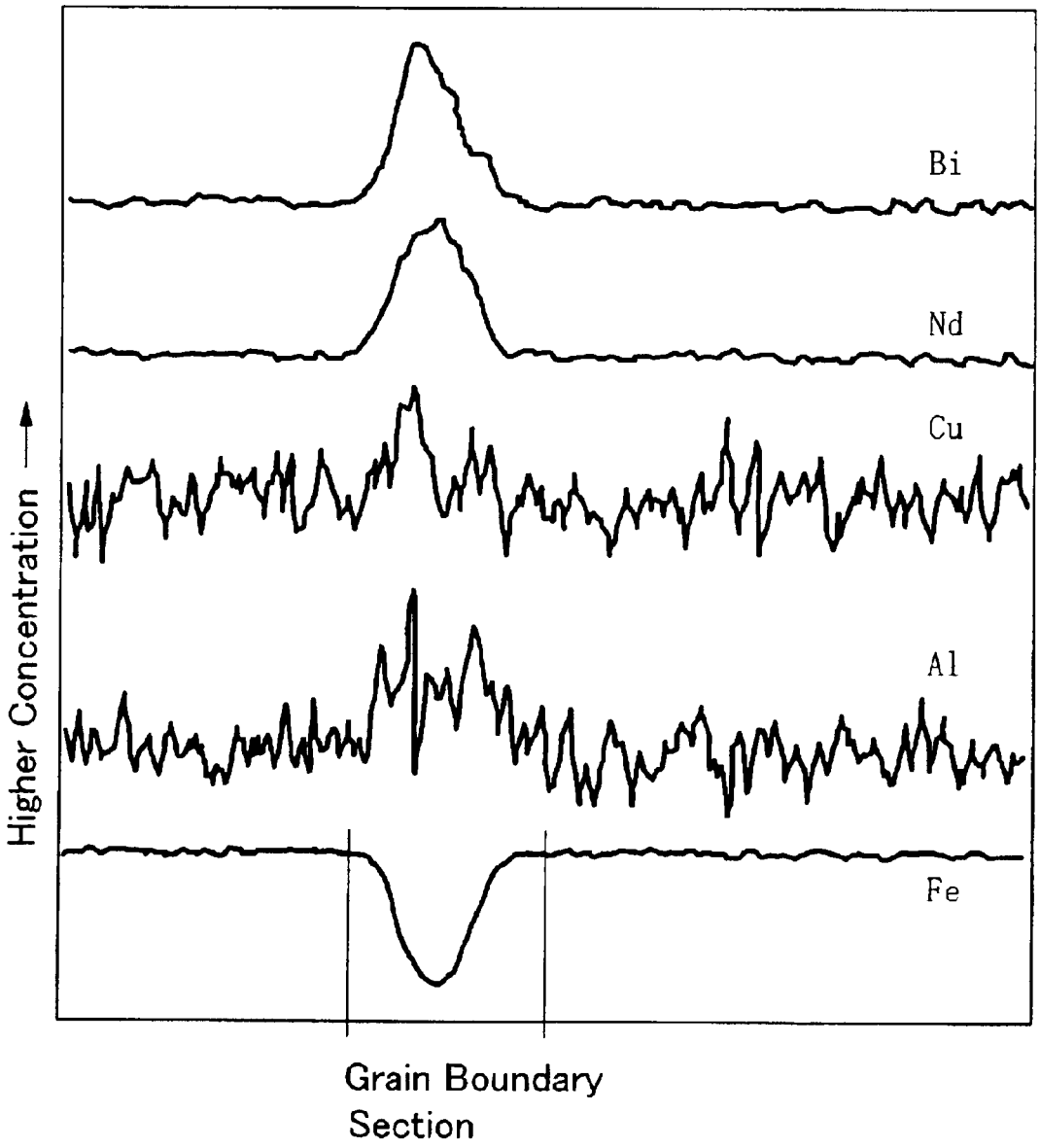
FIG. 8 is a graph showing the results of quantitative line segment analysis by EPMA of Sample No. 1.
Figure 9:
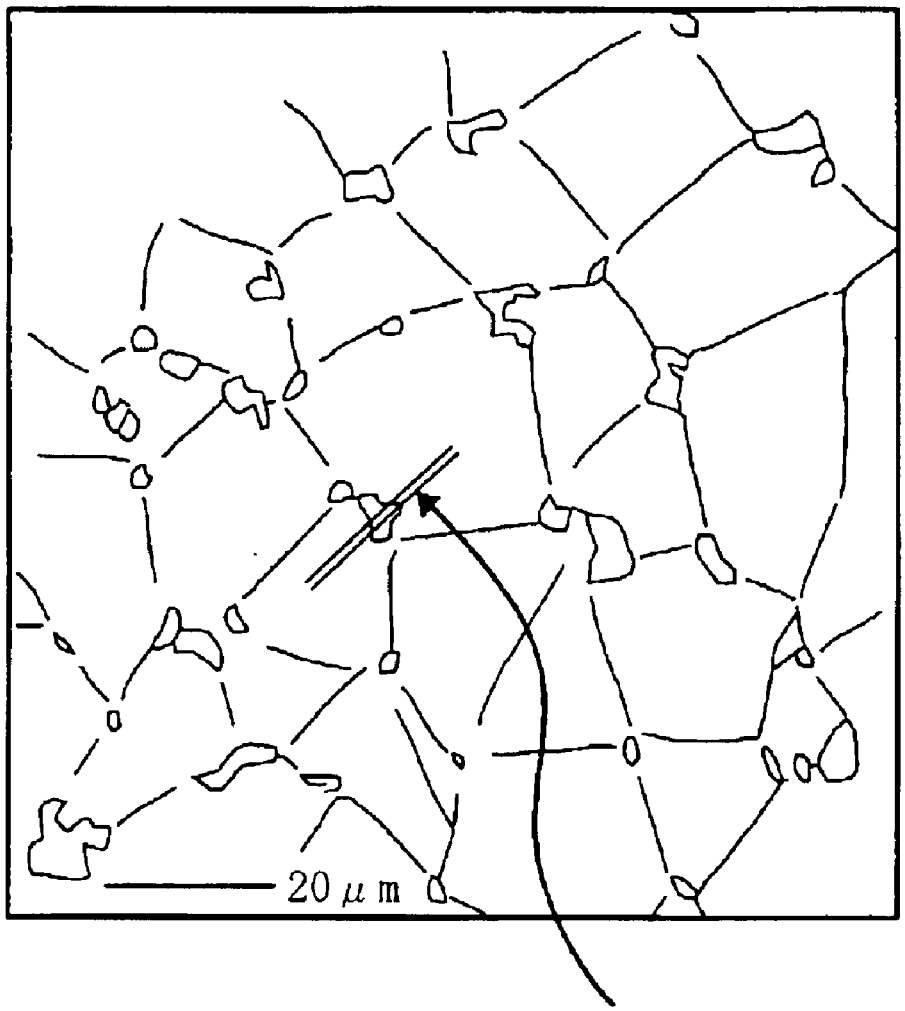
FIG. 9 is a drawing showing the place where the line segment was analyzed in Embodiment Example 7.

FIG. 8 shows the quantitative analysis data of Bi, Nd, Cu, Al and Fe by line segment analysis using EPMA. Moreover, FIG. 8 is the results of line segment analysis concerning the portion that includes the grain boundary phase of the sintered magnets as indicated by an arrow in FIG. 9.

As shown in FIG. 8, the high concentration peak of Bi and that of Nd coincide as well as the low concentration peak of Fe, it can be judged that Bi exists in the non-magnetic grain boundary phase called Nd-rich phase. However, there were cases wherein Bi was not detected, when other grain boundary phases were analyzed. On the other hand, within the scope of the analysis results on line segments, no grains containing Bi were detected. Accordingly, it is believed that Bi is dispersed within the grain boundary phase in the sintered magnet. That is, Bi non-continuously exists as an independent R—Fe—Bi compound in the grain boundary phase called Nd-rich phase, with its grain size be smaller than the thickness of the grain boundary phase. As a result of analyzing the R—Fe—Bi compounds in detail, some $R_6Fe_{13}Bi_1$ compounds ($Nd_6Fe_{13}Bi_1$, etc.) having a tetragonal crystal structure, were detected therein. We assume that Bi in the grain boundary phase gives cause to the effect of the present invention, wherein a high coercive force is obtained with restraining a decline in residual magnetic flux density Br.

Also, the measured mean grain size of the sintered magnet was within the range between 3 μm and 10 μm. Therefore, it is believed that the mean grain size may preferably be between 3 μm and 10 μm, and more preferably, between 5 μm and 8 μm. Moreover, the percentage of large grains with grain sizes being 10 μm and greater included in the sintered magnet may preferably be less than 15%.

As explained in detail above, the present invention allows obtaining rare earth permanent magnets with excellent coercive force and residual magnetic flux density while reducing the cost.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A rare earth permanent magnet consisting essentially of from 20 wt % to 40 wt % of at least one rare earth element R, from 0.5 wt % to 4.5 wt % of boron B, from 0.03 wt % to 0.5 wt % of M that is at least one element selected from the group of Al, Cu, Sn and Ga, from 0.01 wt % to 0.2 wt % of Bi, and the balance being at least one transition metal element T.

2. A rare earth permanent magnet comprising from 20 wt % to 40 wt % of at least one rare earth element R, from 0.5 wt % to 4.5 wt % of boron B, from 0.03 wt % to 0.5 wt % of M that is at least one element selected from the group of Al, Cu, Sn and Ga, from 0.01 wt % to 0.2 wt % of Bi, and at least one transition metal element T.

3. A rare earth permanent magnet according to claim 2, wherein the R consists of Nd and Dy, and the total weight percentage of Nd and Dy is from 31 wt % to 32.5 wt %.

4. A rare earth permanent magnet according to claim 3, wherein the Dy content is from 2 wt % to 15 wt %.

5. A rare earth permanent magnet according to claim 3, wherein the Dy content is from 4 wt % to 9 wt %.

6. A rare earth permanent magnet according to claim 2, wherein the B content is from 0.5 wt % to 1.5 wt %.

7. A rare earth permanent magnet according to claim 2, wherein the M consists of 0.15 wt % or less (but not 0 wt %) of Cu, from 0.15 wt % to 0.3 wt % of Al, and 2 wt % or less of Co (but not 0 wt %).

8. A rare earth permanent magnet according to claim 2, wherein the Bi content is from 0.01 wt % to 0.15 wt %.

9. A rare earth permanent magnet according to claim 2, wherein the T is Fe.

10. A rare earth permanent magnet according to claim 2, wherein the R consists of Nd and Dy, and the total weight percentage of Nd and Dy is from 31 wt % to 32.5 wt %, the M consists of 0.15 wt % or less (but not 0 wt %) of Cu, from 0.15 wt % to 0.3 wt % of Al, and 2 wt % or less of Co (but not 0 wt %), the Bi content is from 0.01 wt % to 0.2 wt %, and the T is Fe.

11. A rare earth permanent magnet according to claim 2, comprising a residual magnetic flux density Br of 1.25 T or greater, and a coercive force Hcj of 1,650 kA/m or greater.

12. A rare earth permanent magnet according to claim 2, wherein Bi is dispersed in a grain boundary phase.

13. A rare earth permanent magnet according to claim 2, wherein a product (Br×Hcj) of a residual magnetic flux density Br and a coercive force Hcj is 2,100 (T×kA/m) or greater, and a value obtained by dividing the coercive force Hcj by a weight percentage of the heavy rare earth element (Hcj/weight percentage of heavy rare earth element) is 230 (kA/m×1/wt %) or greater.

14. A rare earth permanent magnet according to claim 2, wherein a value obtained by dividing a coercive force Hcj by a weight percentage of Bi (Hcj/weight percentage of Bi) is 8,000 (kA/m×1/wt %) or greater.

15. A rare earth permanent magnet consisting essentially of from 20 wt % to 40 wt % of at least one rare earth element R, from 0.5 wt % to 4.5 wt % of boron B, from 0.01 wt % to 0.2 wt % of Bi, and the balance being at least one transition metal element T.

16. A rare earth permanent magnet comprising from 20 wt % to 40 wt % of at least one rare earth element R, from 0.5 wt % to 4.5 wt % of boron B, from 0.01 wt % to 0.2 wt % of Bi, and at least one transition metal element T.

17. A rare earth permanent magnet according to claim 16, wherein a product (Br×Hcj) of a residual magnetic flux density Br and a coercive force Hcj is 2,100 (T×kA/m) or greater, and a value obtained by dividing the coercive force Hcj by a weight percentage of the heavy rare earth element (Hcj/weight percentage of heavy rare earth element) is 230 (kA/m×1/wt %) or greater.

18. A rare earth permanent magnet according to claim 16, wherein a value obtained by dividing a coercive force Hcj by a weight percentage of Bi (Hcj/weight percentage of Bi) is 8,000 (kA/m×1/wt %) or greater.

19. A rare earth permanent magnet comprising a $R_2T_{14}B$ magnetic phase and a non-magnetic grain boundary phase wherein Bi is dispersed, where a value obtained by dividing a coercive force Hcj by a weight percentage of Bi (Hcj/weight percentage of Bi) is 8,000 (kA/m×1/wt %) or greater.

* * * * *

UNITED STATES PATENT AND TRADEMARK OFFICE

CERTIFICATE OF CORRECTION

PATENT NO. : 6,833,036 B2
DATED : December 21, 2004
INVENTOR(S) : Nakane et al.

It is certified that error appears in the above-identified patent and that said Letters Patent is hereby corrected as shown below:

Title page,
Item [57], ABSTRACT, after "consists" and before "of" insert -- essentially --.

Column 6,
Line 59, after "to" and before "$\mu$m" delete "1".

Signed and Sealed this

Twenty-fourth Day of May, 2005

JON W. DUDAS
*Director of the United States Patent and Trademark Office*